US011062574B2

(12) United States Patent
Savage, Jr. et al.

(10) Patent No.: US 11,062,574 B2
(45) Date of Patent: Jul. 13, 2021

(54) STROBE NOTIFICATION APPLIANCE AND EMERGENCY LIGHTING APPLIANCE WITH DIRECTIONAL INFORMATION

(71) Applicant: Johnson Controls Fire Protection LP, Boca Raton, FL (US)

(72) Inventors: Kenneth Savage, Jr., Fitchburg, MA (US); Brian John Scheufele, Shirley, MA (US); Bruce Marien, Gardner, MA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 15/923,213

(22) Filed: Mar. 16, 2018

(65) Prior Publication Data

US 2018/0204429 A1 Jul. 19, 2018

Related U.S. Application Data

(63) Continuation-in-part of application No. 15/004,420, filed on Jan. 22, 2016, now Pat. No. 9,922,509.

(51) Int. Cl.
*G08B 7/06* (2006.01)
*G08B 5/38* (2006.01)

(52) U.S. Cl.
CPC ..... *G08B 7/066* (2013.01); *G08B 5/38* (2013.01)

(58) Field of Classification Search
None
See application file for complete search history.

(56) References Cited

U.S. PATENT DOCUMENTS 3,964,047 A * 6/1976 Antonaccio ..... G08B 26/002 340/538
5,428,912 A * 7/1995 Grondal ..... G02B 6/0055 362/800

(Continued)

FOREIGN PATENT DOCUMENTS

GB 2220288 A * 4/1990

OTHER PUBLICATIONS

Non-Final Office Action for U.S. Appl. No. 15/004,420 dated Dec. 23, 2016; 10 pages.

(Continued)

*Primary Examiner* — Curtis J King
(74) *Attorney, Agent, or Firm* — Arent Fox, LLP

(57) ABSTRACT

A strobe notification appliance and an emergency lighting appliance that output directional information are disclosed. The strobe notification appliance may generate, in addition to notification of the fire condition, directional information (e.g., such as away from the unavailable exit paths and/or toward the preferred exit paths). For example, the strobe notification appliance includes a strobe element outputting fire notification information and a directional light element outputting directional information. The emergency lighting appliance may also operate in different modes, such as a power failure mode in which the emergency lighting appliance outputs light responsive to a power failure, and an alert mode (e.g., fire alert or mass notification alert mode) in which the emergency lighting appliance outputs light to convey directional information in order to guide occupants of a building. In this way, the occupants may be notified of an alarm event and notified of available or unavailable exit paths.

12 Claims, 22 Drawing Sheets

(56) References Cited

U.S. PATENT DOCUMENTS 5,448,462 A * 9/1995 Moran, III ..... F21V 7/005 362/297
5,559,492 A 9/1996 Stewart et al.
5,576,690 A * 11/1996 Waugh ..... G08B 1/08 340/4.13
5,577,834 A * 11/1996 Mazies ..... F21S 8/033 362/298
5,622,427 A 4/1997 Lemons et al.
5,659,287 A * 8/1997 Donati ..... G08B 7/06 315/292
5,815,068 A * 9/1998 Vadseth ..... A62B 3/00 340/332
5,865,527 A 2/1999 Lemons et al.
5,931,573 A * 8/1999 Knox ..... B60Q 1/2611 340/471
6,014,596 A * 1/2000 Bess ..... B60Q 1/2611 340/468
6,025,773 A * 2/2000 Bresnan ..... G08B 6/00 116/205
6,150,943 A * 11/2000 Lehman ..... G08B 7/062 340/332
6,310,551 B1 10/2001 Croft
6,426,697 B1 7/2002 Capowski et al.
6,538,568 B2 3/2003 Conley, III
7,456,585 B2 11/2008 Savage, Jr. et al.
7,999,666 B2 8/2011 Barrieau et al.
8,368,528 B2 2/2013 Savage, Jr. et al.
8,378,806 B2 2/2013 Piccolo, III
8,558,711 B2 10/2013 Savage, Jr. et al.
8,723,682 B2 5/2014 Savage, Jr.
8,773,276 B2 7/2014 Savage, Jr.
8,796,931 B2 8/2014 Savage, Jr.
8,810,415 B2 * 8/2014 Grundler ..... A62B 3/00 340/330
8,845,136 B2 9/2014 Savage, Jr. et al.
8,890,707 B2 11/2014 Savage, Jr.
8,890,708 B2 11/2014 Savage, Jr.
9,185,774 B2 11/2015 Savage, Jr.
9,345,082 B2 5/2016 Savage, Jr.
9,355,535 B2 5/2016 Savage, Jr.
9,466,186 B2 10/2016 Savage, Jr.
9,922,509 B2 3/2018 Marien
2002/0057204 A1 * 5/2002 Bligh ..... G08B 7/062 340/691.1
2004/0075572 A1 * 4/2004 Buschmann ..... G08B 7/062 340/691.1
2005/0073405 A1 4/2005 Spoltore
2005/0128097 A1 * 6/2005 Piccolo, III ..... G08B 7/06 340/691.1
2005/0174251 A1 * 8/2005 Terry, III ..... G08B 7/062 340/691.1
2005/0286247 A1 * 12/2005 Peterson ..... F21S 8/032 362/249.01
2006/0038686 A1 2/2006 Arcaria
2006/0038696 A1 2/2006 Arcaria et al.
2007/0035255 A1 * 2/2007 Shuster ..... G08B 5/38 315/200 R
2007/0069882 A1 3/2007 Mahajan
2007/0132575 A1 * 6/2007 Ellul ..... G08B 5/38 340/524
2008/0022414 A1 1/2008 Cahn
2008/0266121 A1 * 10/2008 Ellul ..... G08B 7/066 340/584
2009/0027225 A1 1/2009 Farley
2009/0059602 A1 * 3/2009 Santos ..... G08B 5/36 362/351
2009/0303700 A1 * 12/2009 Choi ..... B63B 22/166 362/158
2010/0131850 A1 * 5/2010 Berus ..... G01C 21/3632 715/727
2010/0207777 A1 8/2010 Woodford
2010/0309000 A1 * 12/2010 Munthe-Kaas ..... G08B 5/36 340/573.1
2011/0187543 A1 * 8/2011 Russo ..... G08B 17/10 340/628
2012/0038479 A1 * 2/2012 Ten Wolde ..... F21S 4/28 340/540
2012/0238319 A1 9/2012 Lake
2012/0319860 A1 * 12/2012 Savage, Jr. ..... G08B 5/38 340/691.8
2013/0049985 A1 2/2013 Eisenson
2013/0194063 A1 8/2013 Keller
2014/0009301 A1 1/2014 Robotham
2014/0062691 A1 * 3/2014 Graham ..... B60Q 7/00 340/473
2014/0139539 A1 * 5/2014 Byers ..... G09G 5/10 345/589
2015/0070166 A1 * 3/2015 Boyden ..... G08B 25/08 340/540
2015/0123782 A1 * 5/2015 Zwirn ..... G08B 29/126 340/506
2015/0339913 A1 11/2015 Lyman
2016/0007179 A1 * 1/2016 Kim ..... G08B 7/066 455/404.1
2016/0035200 A1 2/2016 Savage, Jr.
2016/0035201 A1 2/2016 Savage, Jr.
2016/0049053 A1 * 2/2016 Simmons ..... G08B 7/066 340/815.4
2016/0123741 A1 5/2016 Mountain
2016/0247369 A1 * 8/2016 Simmons ..... G08B 7/066
2017/0091889 A1 * 3/2017 Chen ..... G06Q 50/265
2018/0181095 A1 * 6/2018 Funk ..... G05B 19/042
2019/0189147 A1 * 6/2019 Monteith ..... H04R 1/025

OTHER PUBLICATIONS

Election/Restriction Requirement for U.S. Appl. No. 15/004,420 dated Jun. 12, 2017; 7 pages.

* cited by examiner

STROBE NOTIFICATION APPLIANCE AND EMERGENCY LIGHTING APPLIANCE WITH DIRECTIONAL INFORMATION

REFERENCE TO RELATED APPLICATION

This application is a continuation-in-part of U.S. application Ser. No. 15/004,420 (now U.S. Pat. No. 9,922,509), which is incorporated by reference herein in its entirety.

BACKGROUND

Fire alarm devices such as audible horns (audible/visible or A/V), loudspeakers (speaker/visible or S/V) and visible strobes (visible only or V/O), are referred to as "notification appliances." Typically, a fire alarm control panel (FACP) drives these devices over one or more "notification appliance circuits" (NACs). The strobes are used, for example, as an alert for the hearing-impaired, or for those in a high noise environment.

Emergency lighting appliances are typically battery-backed lighting devices that switch on automatically when a building, or other type of premises, experiences a power outage. The lights in the emergency lighting appliances may comprise one or more incandescent bulbs or one or more clusters of high-intensity light-emitting diodes (LED).

DETAILED DESCRIPTION

Figure 1:
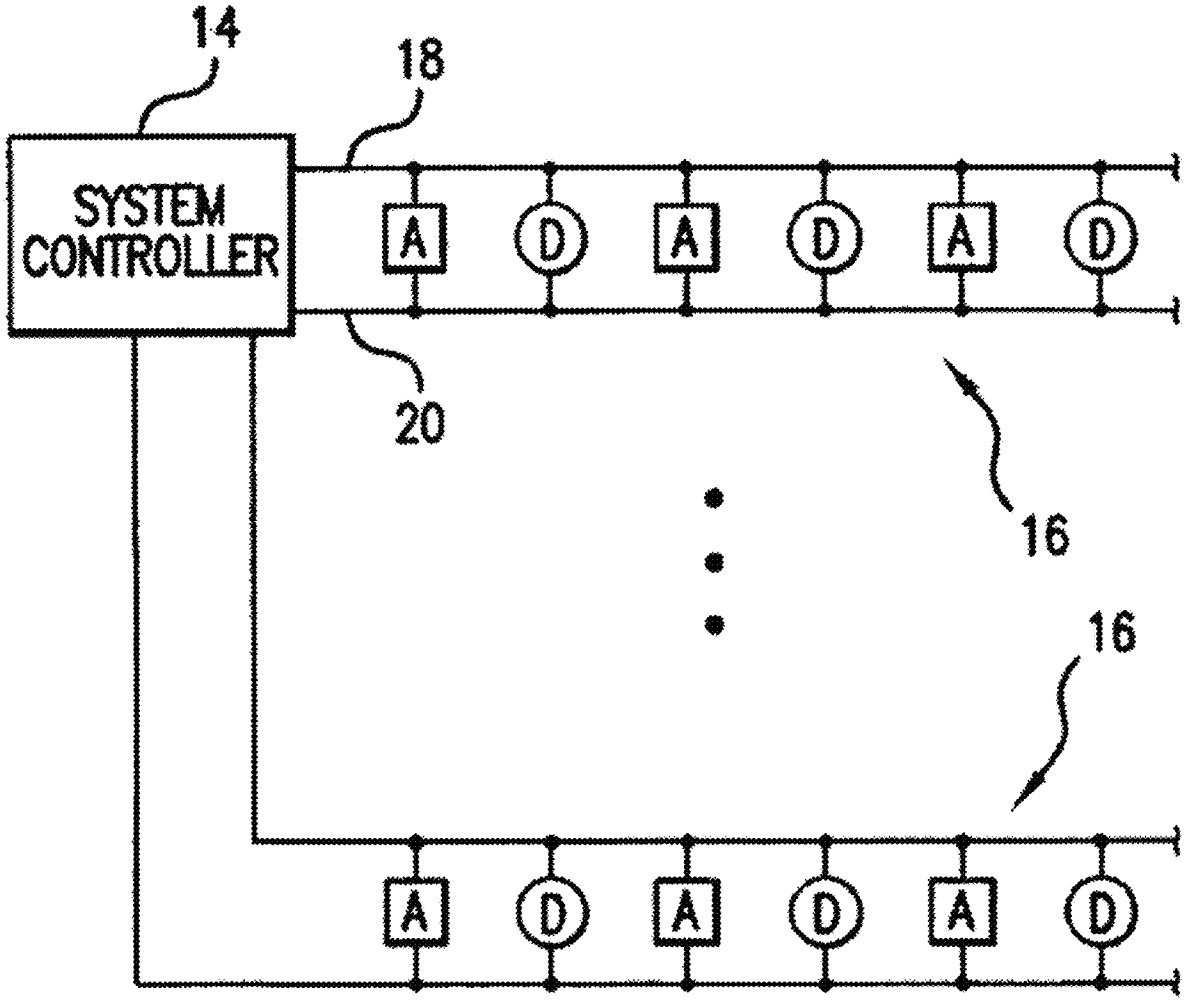
FIG. 1 is a schematic diagram illustrating a fire alarm system.

A notification appliance may be used to notify occupants in a space or premises, such as a building, of a fire or other emergency condition. The notification appliance may use visual (e.g., strobe), audible (e.g., speaker), or a combination of visual/audible outputs to notify the occupants of the fire or other emergency condition.

One type of notification appliance that uses a visual output is a strobe notification appliance. The strobe notification appliance controls a light output element to strobe at a predetermined frequency. As discussed in more detail below, two types of strobe notification appliance are: (1) a flash tube strobe notification appliance; and (2) an LED-based strobe notification appliance. In each type, the strobe notification appliance controls the light output element (either flash tube or LED) to generate the strobed light output at a predetermined frequency, thereby notifying the occupants.

Fire or other emergency conditions may likewise necessitate providing guidance to the occupants as to where to go. In the example of a fire condition, the occupants of the building may need to exit. One way to provide exit information relies upon required static drawings or other instructions posted in common areas to inform building occupants of primary and alternate means of egress from the building. It is commonly expected that building occupants will take notice and review the information provided on these "evacuation plans" in order to be prepared for an orderly evacuation if necessary. Required exit signs are also deployed in an effort at assisting building occupants in locating appropriate exits to egress the building.

However, these static plans as well as the commonly used appliances for providing notification have no means of providing information to building occupants in the event that a path of egress has been compromised, or some other action should be taken by the building occupants. In particular, the fire may result in certain exit paths out of the building being unavailable and certain exit paths preferred. In the example of an emergency condition (such as a hostile intruder or a weather emergency), it may be advisable to instruct the occupants of the building to remain in place. One way to notify occupants where to go is to output an audio warning. This is not a preferable way to notify for the hearing-impaired. Thus, in one embodiment, the strobe notification appliance may notify the occupants of the fire or other emergency condition and likewise provide directional information.

In the fire condition example, the strobe notification appliance may generate, in addition to notification of the fire condition, directional information (e.g., such as away from the unavailable exit paths and/or toward the preferred exit paths). In the emergency condition example, the strobe notification appliance may generate, in addition to notification of the fire condition, directional information (e.g., to shelter in place or to move to a different location).

Figure 7A:
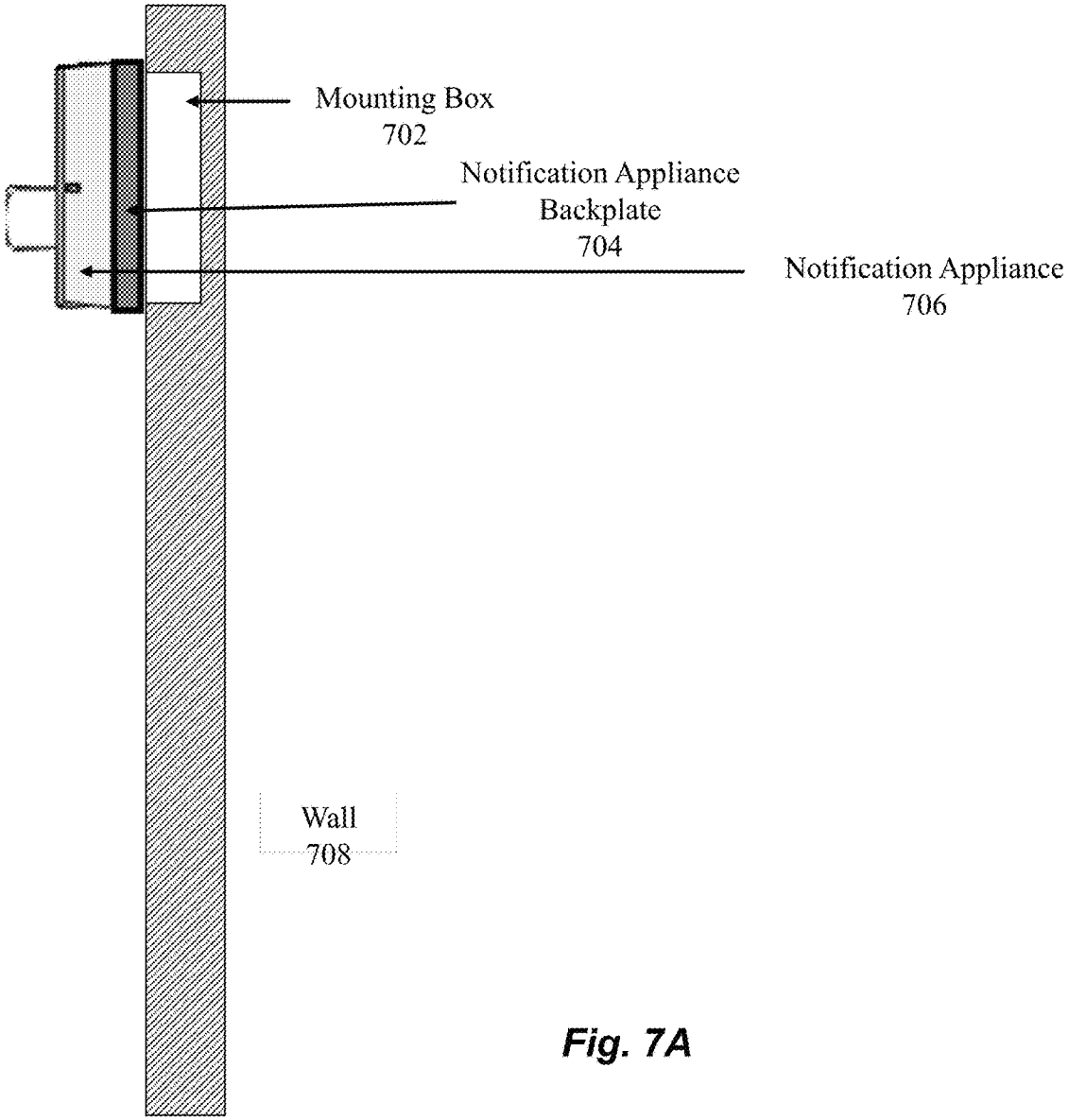
FIG. 7A is a side view of the strobe notification appliance mounted to the wall.
Figure 7B:
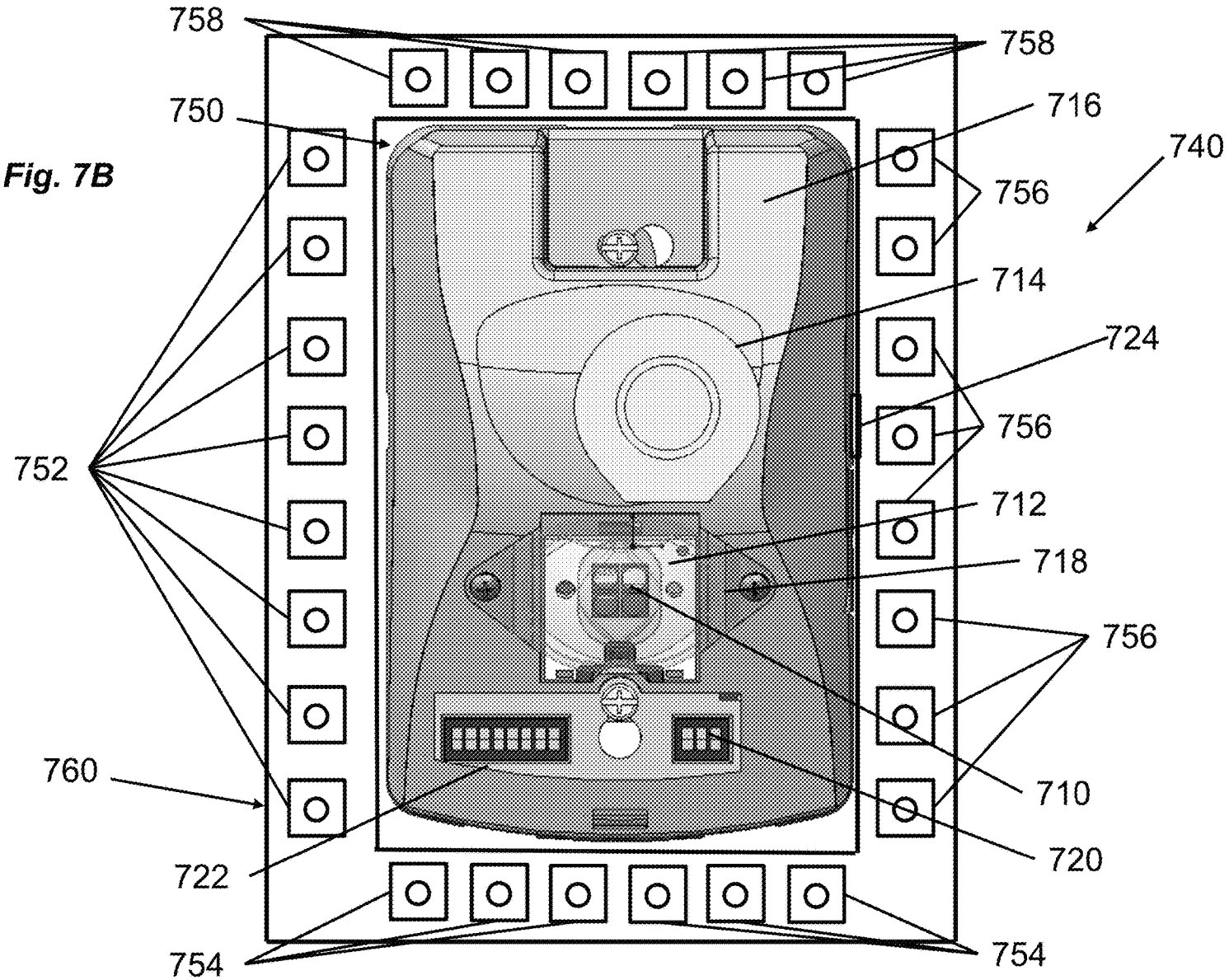
FIG. 7B is a front view of the strobe notification appliance.

In one embodiment, the strobe notification appliance is configured to output the direction information separate from the notification of the fire or emergency condition. In a first more specific embodiment, the strobe notification appliance includes a first visual output configured to output the directional information, and a second visual output configured to output the notification of the fire or emergency condition. For example, the first visual output may include one or more light emitting diodes (LEDs) and the second visual output may include one or more strobe elements (such as a flash tube strobe element or an LED strobe element). The LED(s) may output the directional information in one of several ways. In one way, the LED(s) may output one or more colors to indicate the directional information. In this regard, in one embodiment, single color LEDs may be used. In an alternate embodiment, multi-color LEDs may be used. In particular, outputting the color green on the LED(s) may indicate that a path is recommended, whereas outputting the color red on the LED(s) may indicate that a path is not recommended. Similarly, outputting the color yellow on the LED(s) may indicate that the occupant should stay-in-place. Thus, in response to receiving a command to activate (with the command including directional information), the strobe notification appliance commands the strobe element(s) to generate a strobe output and commands the LED(s) to output the directional information, as discussed in more detail below. In another way, the LED(s) may flash at different rates to indicate the directional information. For example, to convey a recommended direction, the LED(s) may flash at a first rate, and to convey a disallowed direction, the LED(s) may flash at a second rate (with the first rate being different from the second rate). In still another way, the LED(s) may flash at different rates and at a particular color to indicate the directional information. In still another way, certain LED(s) may be lit and other LED(s) may be unlit to convey direction. As one example, the LED(s) may be formed into arrows, with one set of LEDs in the form of a left arrow and a second set of LEDs in the form of a right arrow. The notification appliance may lite the left arrow of LEDs to indicate the recommended direction is left, and may lite the right arrow of LEDs to indicate the recommended direction is right. As another example, the LEDs may be positioned on a right side of the notification appliance and a left side of the notification appliance (such as illustrated in FIG. 7B). In this configuration, the notification appliance may lite the LEDs on the left to indicate the recommended direction is left, and may lite the LEDs on the right to indicate the recommended direction is right.

In a second more specific embodiment, the strobe notification appliance includes a visual output configured to output the notification of the fire or emergency condition (e.g., a strobe element) and a second appliance includes a visual output configured to output the directional information. For example, the second appliance may comprise an exit sign whose light may be controlled to indicate whether to use the exit or not. In particular, the exit sign may be lit when it is recommended to use the exit proximate to the exit sign, whereas the exit sign may be unlit when it is not recommended to use the exit proximate to the exit sign.

In an alternate embodiment, the strobe is configured to output the direction information in conjunction with the notification of the fire or emergency condition. In a first more specific embodiment, the operation of the strobe element (flash tube or LED) is modified, independent of operation of strobe elements on other notification appliances, to convey the directional information. In one example, the frequency of output of light by the strobe element may be modified to convey the directional information. In particular, the frequency may be increased (or decreased) depending on whether to indicate to an occupant of the building to use (or to avoid) a path. In another example, the intensity of the light output may be modified to convey directional information. In particular, the intensity of the light output may be increased to be greater than the candela rating of the strobe notification appliance in order to indicate to an occupant of the building to use a path.

In a second more specific embodiment, the operation of the strobe element (flash tube or LED) is modified, dependent on operation of strobe elements on other notification appliances, to convey the directional information. In one example, the timing of activation of the strobe elements in the different notification appliances is selected to convey directional information. In particular, a series of notification appliances may be along a corridor to an exit. The start of activation of the strobe elements in the series of notification appliances may be timed such as to give a cascading effect toward the exit. In a more specific example, three notification appliances may be positioned in a corridor that has an exit, with the first notification appliance furthest from the exit, the second notification appliance closer to the exit, and the third notification appliance closest to the exit. The activation of the strobe elements on the first, second and third notification appliances may be timed such that the strobe element on the first notification appliance is activated first (e.g., at time t=X seconds), the strobe element on the second notification appliance is activated second (e.g., at time t=X+1 second), and the strobe element on the third notification appliance is activated third (e.g., at time t=X+2 second). In the example of the strobe elements on each of the first, second, and third notification appliances being activated for the same pulse width (e.g., 10 mS or 20 mS in a 1 second cycle), the occupant viewing the cascading activation of the strobe elements may be guided toward the exit. Likewise, the activation of the strobe elements on the first, second and third notification appliances may be timed such that the strobe element on the third notification appliance is activated first (e.g., at time t=X seconds), the strobe element on the second notification appliance is activated second (e.g., at time t=X+1 second), and the strobe element on the first notification appliance is activated third (e.g., at time t=X+2 second), thereby giving the effect of guiding the occupant away from the exit.

The strobe notification appliances may be notified when to activate the strobe element in one of several ways. In one embodiment, the fire alarm panel may send the activation command with the timing information included. For example, the command may include fields correlating the notification appliance's address with the timing information. In the example above, the first notification appliance may be assigned address 0001, the second notification appliance may be assigned address 0002, and the third notification appliance may be assigned address 0003. The fire alarm panel may generate a command that includes the following information correlated to the addresses: 0001: 0; 0002: 1.0; 0003: 2.0. In this regard, a respective strobe notification appliance may access its address (stored locally within the respective strobe notification appliance), and determine the timing information. In an alternative embodiment, the fire alarm panel may cascade the sending the activation command according to the timing information. For example, the fire alarm panel may broadcast a first command (with the address for the first notification appliance and indicative to activate the strobe element) at time t=X, may broadcast a second command (with the address for the second notification appliance and indicative to activate the strobe element) at time t=X+1 second, and may broadcast a third command (with the address for the third notification appliance and indicative to activate the strobe element) at time t=X+2 second. In practice, the respective notification appliance may receive the broadcast commands, determine whether the command includes the address of the respective notification appliance, and activate the strobe in response to determining that an activation command is addressed to it. In this way, staggering the sending of the commands may likewise stagger the timing of the activation of the strobe elements.

An emergency lighting appliance may comprise a battery-backed lighting device that switches on automatically when a building experiences a power outage. For example, the emergency lighting appliance may be used to provide light for walkways, stairwells, exit routes or the like during a power failure. The lights in the emergency lighting appliance may take one or more forms, such as including one or more incandescent bulbs or one or more clusters of high-intensity light-emitting diodes (LED) and/or comprising a sign (such as an EXIT sign). The emergency lighting appliances may be addressable, such as individually addressable and/or addressable as a group. Further, the emergency lighting appliances may be associated with a section or part of a building. In one way, the emergency lighting appliances may be assigned a grouping, such as a grouped as part of a set of emergency lighting appliances positioned in a specific hallway or a specific stairwell. In another way, the emergency lighting appliances may be assigned a specific location. Regardless, the emergency lighting appliance may be associated with a position in the building (e.g., east hallway on fourth floor; north stairwell; etc.).

In one implementation, the emergency lighting appliances may be used to provide directional information to occupants of a building, such as providing an indication of where to go (e.g., a safe passage), where not to go (e.g., an unsafe passage), and/or to stay in place (e.g., a safe place). In this regard, the emergency lighting appliance may operate in different modes. In a first mode, the emergency lighting appliance operates as a typical emergency lighting appliance, providing light for walkways, stairwells, exit routes or the like during a power failure. As discussed further below, responsive to a determination as to a power failure, the emergency lighting appliance may turn on the lamp (or other lighting device) resident in the emergency lighting appliance in order to light a section of a premises during the power failure. For example, in response to the emergency lighting appliance determining, locally, that there is a power failure, the emergency lighting appliance may activate the lamp (or other lighting device). As another example, in response to the control panel determining, centrally, that there is a power failure, the control panel may send a command to all emergency lighting appliances on the premises to activate the lamp (or other lighting device). Responsive to receiving the command, the emergency lighting appliance may activate the lamp (or other lighting device). In a second mode, the emergency lighting appliance operates to provide directional routes/lighting during an alarm event. More specifically, a first sub-mode of the second mode may comprise the emergency lighting appliance operating to provide directional routes/lighting during a fire alarm event. For example, in response to the fire control panel determining, centrally, that there is a fire alarm event, the fire control panel determines a subset of emergency lighting appliances to activate to provide directional information (e.g., safe passage from the fire), and send a command to the subset of emergency lighting appliances to activate the respective lamp (or other lighting device), as discussed further below. A second sub-mode of the second mode may comprise the emergency lighting appliance operating to provide directional routes/lighting during a mass notification event. For example, in response to the mass notification control panel determining, centrally, that there is a mass notification event, the mass notification control panel determines a subset of emergency lighting appliances to activate to provide directional information (e.g., safe passage or stay-in-place), and send a command to the subset of emergency lighting appliances to activate the respective lamp (or other lighting device), as discussed further below.

The emergency lighting system, which includes one or more emergency lighting appliances, may convey the directional information in combination with another notification system, such as a fire notification system, mass notification system, or the like. The emergency lighting appliances may convey directional information in one of several ways. In one way, a first subset of the emergency lighting appliances may be operated differently from a second subset of emergency lighting appliances. In practice, the other notification system may indicate an emergency associated with a specific location in the building. As one example, the fire notification system may indicate that a specific location has a fire (e.g., a smoke detector, associated with the east hallway on the fifth floor, has activated, indicating a fire in the east hallway on the fifth floor) and/or may indicate that a specific location does not have a fire (e.g., a smoke detector, associated with the north stairwell, has not activated, indicating that no fire in the north stairwell and that the north stairwell is safe for passage). As another example, the mass notification system may indicate that a specific location is subject to danger (e.g., a gunman has been reported in Building 2 (of a set of buildings) or has been reported on floor 2 in Building 2) and/or may indicate that a specific location is not subject to danger (e.g., a gunman has been reported in Building 2, but not in Building 1).

Responsive to determining that there is a danger (fire, gunman, or the like) associated with an identified location (such as an identified region), the other notification system, the emergency lighting system, or a combination of the other notification system/emergency lighting system may determine whether (and what) directional information to output via the other notification system and/or the emergency lighting system.

As one example, the other notification system (e.g., fire and/or mass notification) may have a control panel and the emergency lighting system may have a separate control panel. In this example, the control panel of the other notification system, the control panel of the emergency lighting system, or both the control panel of the other notification system and the control panel of the emergency lighting system may determine whether (and what) direction information to output via the other notification system and/or the emergency lighting system. As another example, a single control panel may control both the other notification system and the emergency lighting system.

As discussed above, the control panel(s) may determine any one, any combination, or all of the following: whether to output directional information; what directional information to output; and how to output the directional information. As one example, the control panel(s) may determine whether to output directional information. In a first specific implementation, the control panel(s) may operate in one or more modes, with the modes indicative of whether to output the directional information. In a first mode, the control panel determines to output the directional information, and in a second mode, the control panel determines not to output the directional information. Thus, responsive to determining an event (e.g., a fire alarm event, a mass notification event, etc.), the control panel(s) are configured to determine the mode, and responsive to determining that the mode is indicative of outputting directional information, the control panel determines to output the directional information. In a second specific implementation, the control panel(s) may determine whether to output the directional information based on a dynamic analysis of one or more inputs (e.g., one or more sensor inputs). As one example, responsive to determining that: a first fire alarm sensor (associated with a first region) has activated; a second fire alarm sensor (associated with a second region) has activated; and heat sensors associated with the second region indicate normal temperature, the control panel(s) may determine to output the directional information. As another example, responsive to determining that: the first fire alarm sensor (associated with the first region) has activated; the second fire alarm sensor (associated with the second region) has activated; and heat sensors associated with the second region are indeterminate (the data is inconclusive as to the temperature in the second region), the control panel(s) may determine not to output the directional information.

Further, responsive to determining to output directional information, the control panel(s) may determine what directional information to output. Various types of directional information may be output. As one example, the directional information may indicate to move in a particular direction (e.g., walk down a particular hallway, walk down a particular stairwell). As another example, the directional information may indicate not to move in a particular direction (e.g., not to walk down a particular hallway, not to walk down a particular stairwell). As still another example, the directional information may indicate to remain in place (e.g., do not move).

Still further, the control panel(s) may determine how to output the directional information. Thus, responsive to determining the directional information (e.g., walk down a particular hallway; do not walk down a particular stairwell; remain in place), the control panel(s) may determine in what manner to output the directional information, such as one or both of: (1) which system(s) output directional information (emergency lighting system only, the other notification system only, or both the emergency lighting system and the other notification system output directional information); and (2) what type of directional information to output.

In one implementation, the directional information may be output solely via the emergency lighting system. Thus, the other notification system may operate normally, without an indication of outputting directional information, whereas the emergency lighting system may output the directional information. In another implementation, the emergency lighting system may operate normally, without an indication of outputting directional information, whereas the other notification system (e.g., fire or mass notification) may output the directional information. In still another implementation, both the emergency lighting system and the other notification system may output directional information.

Separate from which systems output directional information (e.g., whether the emergency lighting system output directional information only, the other notification system output directional information only, or both the emergency lighting system and the other notification system output directional information), different types of directional information may be output. In one implementation, the different types may comprise differences in operation of the appliances within a single system (e.g., different operations of emergency lighting appliances within the emergency lighting system, different operations of fire notification appliances within the fire notification system, or different operations of mass notification appliances within the mass notification system). The different operations may comprise any one, any combination, or all of: (1) flash vs. no flash; (2) on vs. off; or (3) timing of flash. As one example, one subset of emergency lights may be flashed in order to indicate the directional information (e.g., for the occupants to move in the direction of the flashing lights) and another subset of emergency lights may be constantly on. In particular, in one implementation, the one subset of emergency lights in the emergency lighting system may flash (turn on an off, such as outputting light for 0.5 sec and not outputting light for 0.5 sec or outputting light for 0.75 sec and not outputting light for 0.25 sec). As another example, one subset of emergency lights may be constantly on in order to indicate the directional information (e.g., for the occupants to move in the direction of the flashing lights) and another subset of emergency lights may be off (e.g., no light output). As still another example, one subset of emergency lights may be flashed in order to indicate the directional information (e.g., for the occupants to move in the direction of the flashing lights) and another subset of emergency lights may be off (e.g., no light output). As yet another example, one subset of emergency lights may be flashed at a higher frequency than another subset in order for the one subset to indicate the directional information. In this regard, the directional information may be output via controlling the frequency and/or timing of the light output via the emergency lighting appliances.

In another implementation, the outputs from the different systems may indicate directional information. In a first specific implementation, the outputs from the different systems are different. As one example, a subset of the emergency lighting appliances in the emergency lighting system are constantly on (in order to indicate a direction to a safe exit away from the fire) and the fire notification appliances in the fire notification system are strobing (to indicate a fire event). As another example, a subset of the emergency lighting appliances in the emergency lighting system are constantly on (in order to indicate a direction to a safe exit away from an active shooter) and the mass notification appliances in the mass notification system are strobing (to indicate a mass notification event). Thus, the appliances for the different systems operate differently to indicate the directional information, such as different operation of the emergency lighting appliances in the emergency lighting system versus the operation of the fire notification appliances in the fire notification system, or different operation of the emergency lighting appliances in the emergency lighting system versus the operation of mass notification appliances in the mass notification system.

In a second specific implementation, the outputs from the different systems are of a same type. As one example, a subset of the emergency lighting appliances in the emergency lighting system strobe (in order to indicate a direction to a safe exit away from the fire) and the fire notification appliances in the fire notification system strobe as well (to indicate a fire event). In one configuration, the fire notification applications convey directional information (such as via strobing or via additional lights on the fire notification appliance) so that both the fire notification system and the emergency lighting system convey directional information. As discussed further below, the frequency of strobing may be different for the fire notification applications versus the emergency lighting appliances (e.g., a rate of the strobing for the fire notification appliance or the mass notification appliance is different, such as at a higher rate, than a rate of the strobing for the emergency lighting appliance). In another configuration, the fire notification appliances operate traditionally and do not convey directional information whereas the emergency lighting appliances in the emergency lighting system convey directional information. As another example, a subset of the emergency lighting appliances in the emergency lighting system strobe (in order to indicate a direction to a safe exit away from the fire) and the mass notification appliances in the mass notification system strobe as well (to indicate a mass notification event). In one configuration, the mass notification appliances convey directional information (such as via strobing or via additional lights on the fire notification appliance) to indicate to move or to remain in place, so that both the mass notification system and the emergency lighting system convey directional information. In another configuration, the mass notification appliances operate traditionally and do not convey directional information whereas the emergency lighting appliances in the emergency lighting system convey directional information.

A system embodying one example of the present invention is illustrated in FIG. 1. The system in FIG. 1 is directed to a fire alarm system. Notification appliances in an emergency notification system may likewise be used. The system includes one or more notification appliance circuits (NACs), i.e., networks 16, having alarm condition detectors D and alarm system notification appliance A. Alternatively, the detectors and notification appliances may be on separate networks. A system controller (such as a fire alarm control panel (FACP)) 14 may monitor the detectors D.

The system controller 14 may monitor the alarm condition detectors D. When an alarm condition is sensed, the system controller 14 may signal the alarm to the appropriate notification appliances A through the one or more appliance circuits. Notification appliances may include, for example, a visual alarm (such as a strobe), an audible alarm (such as a horn), or a combination thereof.

Although not necessary for carrying out the invention, as shown, all of the notification appliances in a network are coupled across a pair of power lines 18 and 20 that advantageously also carry communications between the system controller 14 and the detectors D and notification appliances A.

The system controller 14 may comprise a fire alarm control panel and may use one or more commands to signal the alarm to the appropriate notification appliances A. Examples of commands issued for a system with addressable notification appliances are disclosed in U.S. Pat. No. 6,426,697, which is hereby incorporated by reference in its entirety. Alternatively, the communication line to the device may be separate from the power line. In still an alternative embodiment, the system may include non-addressable notification appliances. The communications channel may comprise, for example, a wireless link, a wired link or a fiber optic link.

Further, the system controller 14 may send one or more commands relating to diagnostics, status, or other non-alarm type events. For example, the system controller 14 may send a command related to the identification, the configuration, and/or the status of the notification appliances A. Moreover, the notification appliances A may respond in kind.

One, some, or all of the notification appliances A may comprise a strobe notification appliance. The strobe notification appliance may be an addressable strobe notification appliance (e.g., the strobe notification appliance has a uniquely assigned address) or a non-addressable strobe notification appliance. Further, in one embodiment, the strobe notification appliance may operate in one of multiple modes, such as a first mode and a second mode. In one implementation, the first mode is different from the second mode in one or more ways. Examples of differences in the modes include, without limitation: timing of activation of the strobe element; duration of activation of the strobe element; intensity of activation of the strobe element; and frequency of activation of the strobe element.

As discussed in more detail below, the fire alarm control panel may send a command to one or more strobe notification appliances to active the strobe element associated with the strobe notification appliance.

Figure 2A:
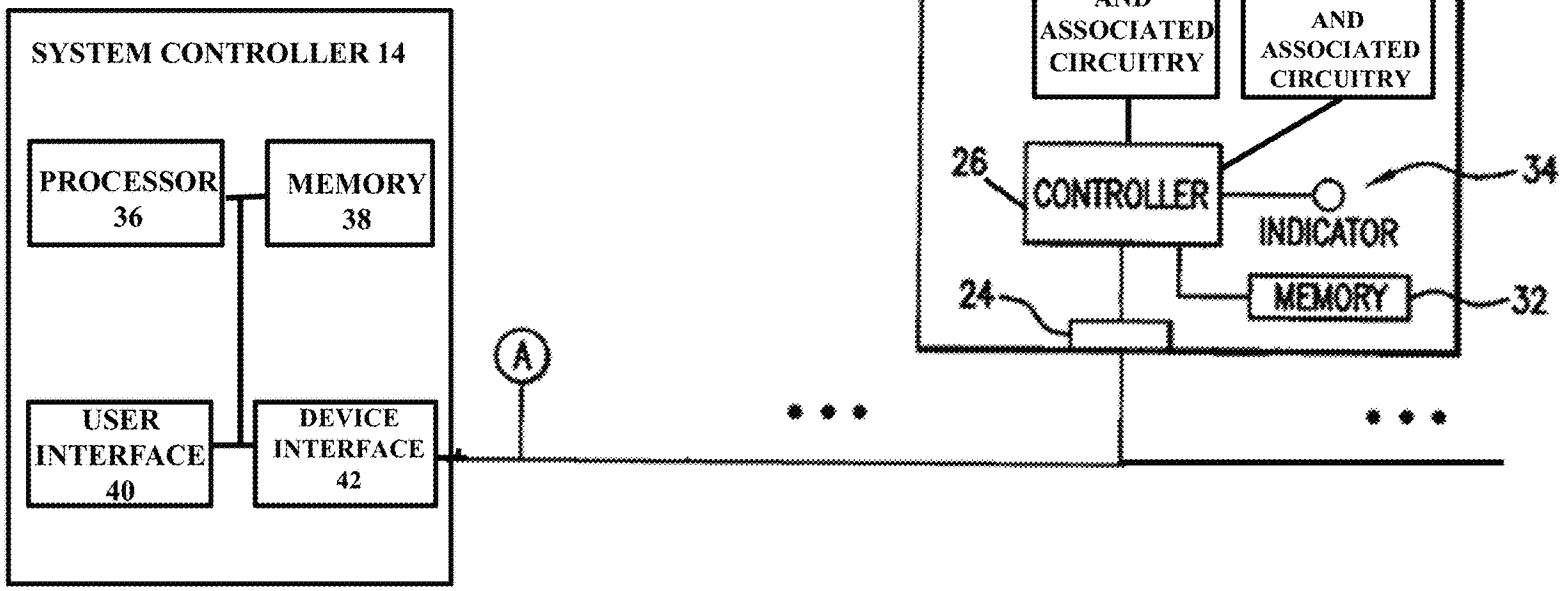
FIG. 2A is a schematic diagram of the system of FIG. 1, further illustrating details of a system controller and a strobe notification appliance with a strobe element and a separate directional information element.

FIG. 2A is a schematic diagram of the system of FIG. 1, further illustrating details of a system controller 14 and a strobe notification appliance with a strobe element and a separate directional information element. The system controller 14 includes a processor 36, a memory 38, a user interface 40, and a device interface 42. The processor 36 may comprise a microprocessor, a microcontroller, a digital signal processor, an application specific integrated circuit (ASIC), a field programmable gate array, a logical digital circuit, or other now known or later developed logical processing capability. The processor 36 may work in combination with the memory 38 in order to monitor part or all of the fire alarm system, including one or more of the appliance circuits (such as one or more notification appliance circuits, one or more detector circuits, and/or one or more notification appliance/detector circuits). In addition, the memory 38 may include one or more look-up tables (or other data structures) used for configuration.

User interface 40 may be used by an operator to control configuration and/or operation of the alarm condition detectors D and alarm system notification appliances A. Further, device interface 42 comprises a communications interface between the system controller 14 and the alarm condition detectors D and alarm system notification appliances A in the one or more appliance circuits.

FIG. 2A further depicts a strobe notification appliance 30 in greater detail. The strobe notification appliance 30 connects to the network 16 via a network interface (communication connection) 24. The strobe notification appliance 30 receives one or more commands from the system controller 14. The controller 26 processes the one or more commands, as discussed in more detail below. Although shown separately, the memory 32 may be integrated with the controller 26.

The strobe notification appliance 30 further includes strobe element and associated circuitry 44. The strobe element may comprise a clear or an amber or otherwise colored strobe element. In one embodiment, the strobe element is a flash-tube based strobe element (also called a flash lamp strobe element). Typically, the flash tube is an electric glow discharge lamp designed to produce extremely intense, incoherent, full-spectrum white light for very short durations. Flash tubes are made of a length of glass tubing with electrodes at either end and are filled with a gas that, when triggered, ionizes and conducts a high voltage pulse to produce the light. One example of the gas that can fill the flash tube is xenon, with a xenon flash tube producing a high-intensity light (such as thousands of lumens) for a very short duration pulse (such as hundreds of microseconds). Xenon flash tubes use a high voltage storage element, such as an electrolytic capacitor, that can be charged several hundred volts to provide energy for the flash. Xenon flash tubes also use a trigger voltage that is in the several thousand-volt range to start the gas discharge.

In an alternate embodiment, the strobe element is a Light Emitting Diode (LED)-based strobe element. Typically, an LED-based strobe cannot generate light at as high of an intensity as a Xenon-based strobe. Instead, LED-based strobes generate a lower intensity light (such as hundreds of lumens) for a longer period of time (such as tens to hundreds of milliseconds). In this way, the LED-based strobes can generate a comparable amount of light energy, as measured in candela, as a Xenon-based strobe. Further, an LED-based strobe is a semiconductor device that can be run off a lower voltage than a Xenon-based strobe, thus eliminating the high voltage circuitry. A capacitor may still be used for energy storage in the LED-based strobe, albeit for a lower output voltage. Because of its physical characteristics, an LED-based strobe can be turned on either continuously or pulsed. Factors that may limit the light output of the LED-based strobe are junction temperature and luminosity versus current, as determined by the LED chip materials and bonding wires. Finally, in contrast to flash-tube based strobes, LED-based strobes typically have a longer usable lifetime.

The strobe notification appliance 30 also includes directional informational element and associated circuitry 46. In one embodiment, the controller 26 is configured to activate the strobe element at least partly simultaneously with the directional information element, as discussed in more detail below.

One example of a directional informational element is an LED (or a series of LEDs) separate from the strobe element. In the example of an LED-based strobe element, the LED (or a series of LEDs) may differ from the LED-based strobe element in one of multiple ways. In one way, the LED (or a series of LEDs) may differ from the LED-based strobe element in composition. For example, the LED (or a series of LEDs) may comprise low-power LEDs (e.g., low current LEDs) whereas the LED-based strobe element may comprise high-power LED(s) (e.g., high current LEDs). For example, the LEDs configured to convey directional information may operate at a lower current than the LEDs configured to operate as the strobe element of the notification appliance. In another way, the LED (or a series of LEDs) may differ from the LED-based strobe element in operation. For example, the LED (or a series of LEDs) may be operated to be constantly on when activated whereas the LED-based strobe element may be operated to be strobed when activated. Thus, in operation, the LED-based strobe element may be turned on for a fraction of each second (e.g., 20 mS) whereas the LED (or a series of LEDs) may be on for longer intervals (such as constantly on or flashing for durations longer than 20 mS), so that both the LED-based strobe and the LED (or a series of LEDs) are on simultaneously for that fraction of each second (e.g., only 20 mS per second). One example of the directional LEDs comprise organic light-emitting diodes (OLEDs).

In some embodiments, an indicator 34, such as a flashing LED (separate from the strobe element and associated circuitry 44, and separate from the directional information element and associated circuitry 46), may be used as an output, for example during diagnostic testing, on the strobe notification appliance 30. The indicator 34 may be activated, for example, upon command from the system controller 14, upon a local manual command such as a pushbutton (not shown). Alternatively, the directional information element may be used during diagnostic testing. For example, one or more of the directional LEDs may be used during diagnostic testing. In this regard, the one or more of the directional LEDs may serve multiple purposes.

As discussed above, the strobe notification appliance 30 includes directional informational element and associated circuitry 46. In one embodiment, directional informational element and associated circuitry 46 may be integral with other functionality in strobe notification appliance 30. In this regard, the system controller 14 may use the same address when controlling both the strobe element and the directional information element. In an alternate embodiment, directional informational element and associated circuitry 46 may be a modular add-on for an existing addressable strobe notification appliance. In particular, the directional informational element and associated circuitry 46 may be a retrofit for an existing strobe notification appliance, as discussed in more detail with regard to FIGS. 7A-B. As discussed in more detail below, the directional information element may comprise one or more LEDs. The one or more LEDs may be multi-color LEDs. For example, the multi-color LEDs may be configured to output green color, red color, etc. Alternatively, the one or more LEDs may be single color LEDs. For example, the one or more LEDs may comprise a first set of LEDs of a first single color (e.g., red LEDs), a second set of LEDs of a second single color (e.g., green LEDs), a third set of LEDs of a third single color (e.g., yellow LEDs), etc. In one embodiment, only a single set of LEDs is activated as a single time (e.g., only the red LEDs are activated). In an alternate embodiment, multiple sets of LEDs may be activated simultaneously. As discussed below with respect to FIG. 7B, a first color (e.g., red) may be activated on the left side of the notification appliance while a second color (e.g., green) may be activated on the right side of the notification appliance. In this way, occupants may be notified to exit to the right.

In one embodiment, the retrofitted strobe notification appliance (including the strobe element and the directional informational element) may use a single address. Thus, when sending commands, the system controller 14 may use the same address when controlling both the strobe element and the directional information element. In an alternate embodiment, the retrofitted strobe notification appliance may use separate addresses, one address for controlling the strobe element and a different address for controlling the directional informational element.

Further, in one embodiment, the strobe element and associated circuitry 44 may be on a separate printed circuit board than the directional information element and associated circuitry 46. In particular, the separate printed circuit boards may reduce electrical interaction between the strobe element and associated circuitry 44 and directional information element and associated circuitry 46. In an alternative embodiment, the strobe element and associated circuitry 44 and directional information element and associated circuitry 46 may be on a single printed circuit board.

Figure 2B:
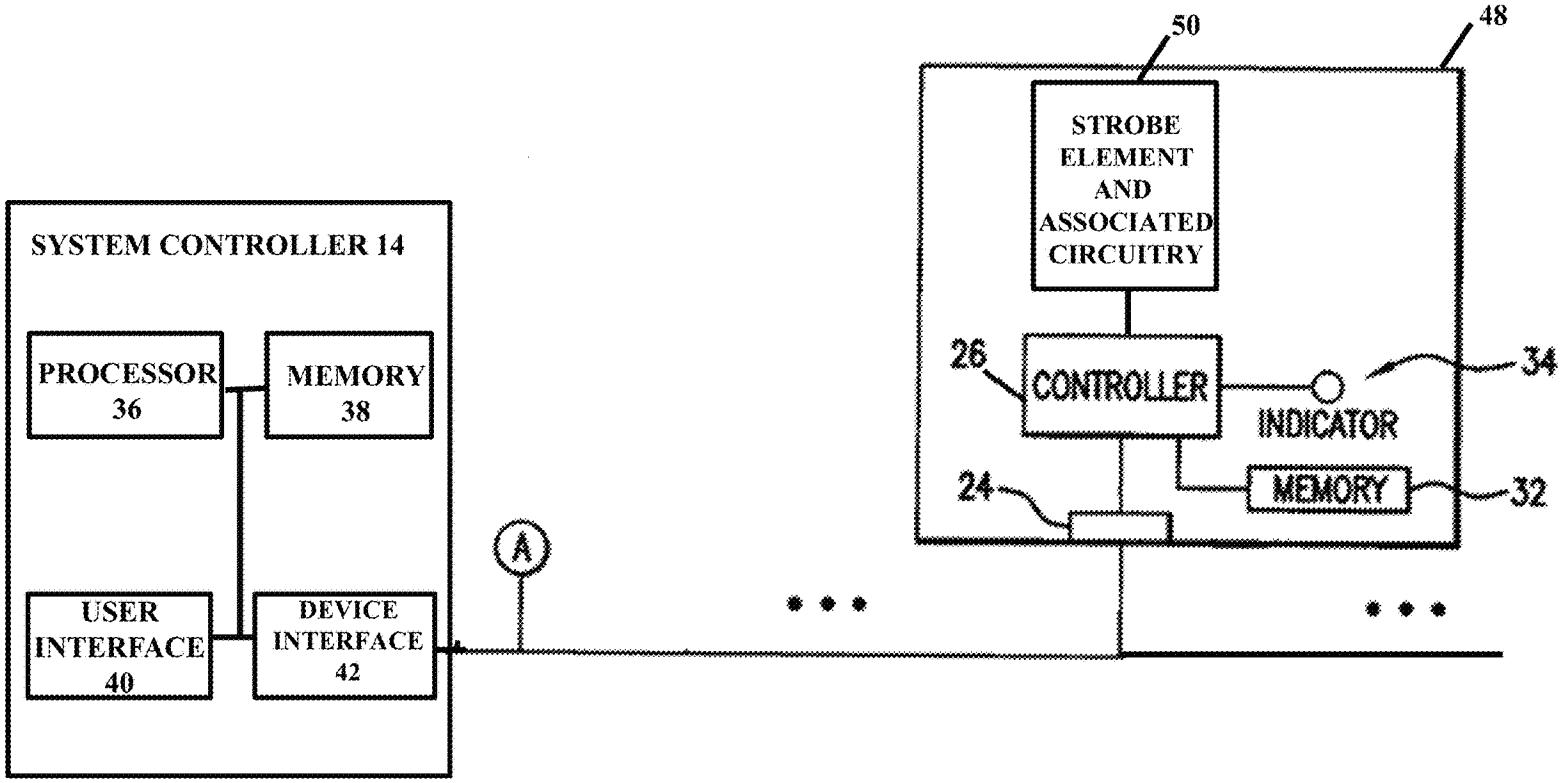
FIG. 2B is a schematic diagram of the system of FIG. 1, further illustrating details of a system controller and a strobe notification appliance with a strobe element that generates a strobe output and directional information.

FIG. 2B is a schematic diagram of the system of FIG. 1, further illustrating details of a system controller 14 and a strobe notification appliance 48 with a strobe element that generates a strobe output and directional information. The strobe notification appliance 48 includes strobe element and associated circuitry 50. In one embodiment, the strobe element is a flash-tube based strobe element. In an alternate embodiment, the strobe element is an LED-based strobe element. The strobe element and associated circuitry 50 is configured to output both notification information and directional information. In particular, the control of the strobe element may be adjusted in order to output both the notification information and the directional information, as discussed in more detail below.

Figure 3A:
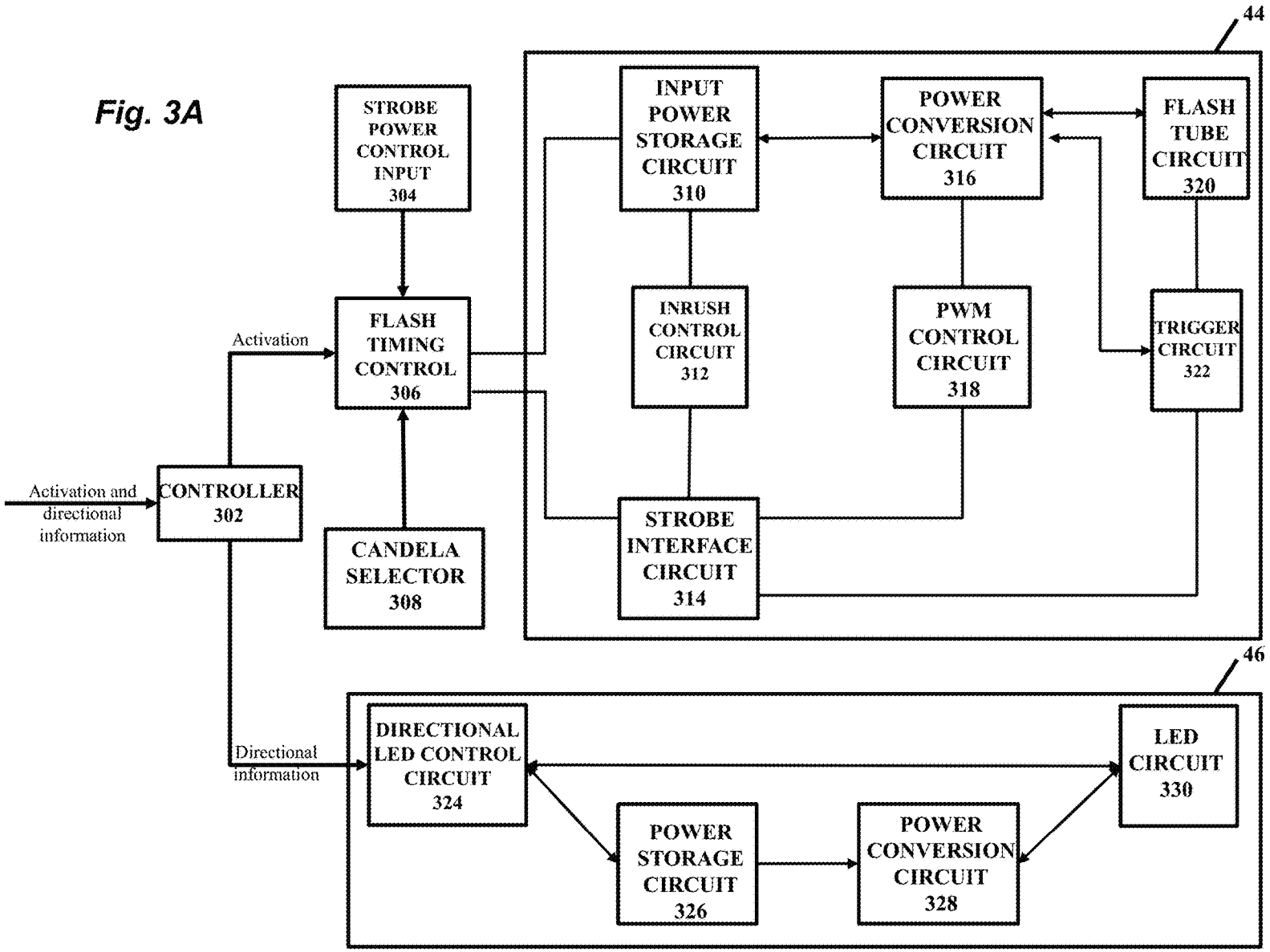
FIG. 3A illustrates one example of an expanded block diagram of the strobe notification appliance (including a flash tube strobe element and associated circuitry, and directional information element and associated circuitry) illustrated in FIG. 2A.

FIG. 3A illustrates one example of an expanded block diagram of the strobe notification appliance (including a flash tube strobe element and associated circuitry, and directional information element and associated circuitry) illustrated in FIG. 2A. In one embodiment, the strobe notification appliance 30 receives a command that includes activation and directional information. Alternatively, the strobe notification appliance 30 receives the activation and directional information in separate communications.

As illustrated in FIG. 3A, the controller 302 receives the activation and directional information. The controller 302 may parse the received information, and send control signals to other parts of the circuitry depicted in FIG. 3A. In one embodiment, the controller 302 may send the activation information and the directional information to parts of the circuitry, such as depicted in FIG. 3A. Alternatively, the controller 302 may send control signals based on the activation information and the directional information.

The strobe power control input 304 is configured to receive power to power the strobe notification appliance 30. Flash timing control 306 is configured to control the timing of the flashes of the strobe element (or strobe elements). The flash timing control 306 may receive as an input the candela selector 308, which may be an input device on the strobe notification appliance 30 (such as a multi-position switch). An example of the switch is disclosed in U.S. Pat. No. 7,456,585, incorporated by reference herein in its entirety. Examples of candela settings include 15, 30, 75, and 110. Alternatively, the candela setting may be pre-programmed and stored in memory 32. In still an alternate implementation, the candela setting may be sent from the fire alarm panel (e.g., system controller 14) to the notification appliance 30. Based on the candela setting, the flash timing control 306 may control the strobe element and associated circuitry 44 to generate an output with the desired candela setting.

As discussed above, one type of strobe element is a flash-tube strobe element, such as discussed in U.S. Pat. No. 8,368,528, incorporated by reference herein in its entirety. The strobe element and associated circuitry 44 includes a strobe interface circuit 314, input power storage circuitry 310, a power conversion circuit 316, a flash circuit 320, inrush control circuit 312, pulse width modulation (PWM) control circuit 318, and a trigger circuit 322.

The input power storage circuitry 310, power conversion circuit 316, flash tube circuit 320, and trigger circuit 322 cooperate to produce a voltage signal with an intensity great enough to energize a flash. For example, the input power storage circuit 310 may correspond to a capacitor or other storage device for storing energy. An inrush control circuit 312 may control the rate at which the input power storage circuit 310 stores energy to prevent excessive current flow into the strobe element and associated circuitry 44. The power conversion circuit 316 may correspond to a voltage amplification circuit such as a transformer-based circuit. For example, a DC-to-AC circuit may convert DC energy transferred from the power conversion circuit 316 to AC voltage. The AC voltage may then be increased via, for example, a step-up transformer, to a voltage great enough to activate a flash such as a xenon flash.

The strobe interface circuit 314 may be in electrical communication with the flash timing control 306. As discussed above, the flash timing control 306 may be utilized to control the behavior of the strobe element and associated circuitry 44. The strobe interface circuit 314 may be utilized to configure the behavior of the power conversion circuit 316 so as to control various characteristics of the strobe, such as the frequency and intensity of the flash. Other characteristics of the strobe element and associated circuitry 44 may be configured via the strobe interface circuit 314.

In some implementations, the strobe interface circuit 314 may include a storage device such as a memory for storing configuration information that controls the characteristics of the strobe element and associated circuitry 44. For example, strobe capability information, such as the maximum lumen capability of the flash or flash usage information, may be stored in the memory and communicated to the processing module. In other implementations, the strobe interface circuit 314 relays configuration information communicated by the processing module to the various other circuits.

FIG. 3A further illustrates that directional information is sent to directional information element and associated circuitry 46. Directional information element and associated circuitry 46 may include directional LED control circuit 324, power storage circuit 326, power conversion circuit 328, and LED circuit 330. Directional LED control circuit 324 may include control circuitry to control various elements in directional information element and associated circuitry 46, such as power storage circuit 326 and LED circuit 330. Power storage circuit 326 is configured to store power, and power conversion circuit 328 is configured to perform power conversion. LED circuit 330 may include one or more LEDs, and may be driven by the directional LED control circuit 324 and supplied with power by power conversion circuit 328.

Figure 3B:
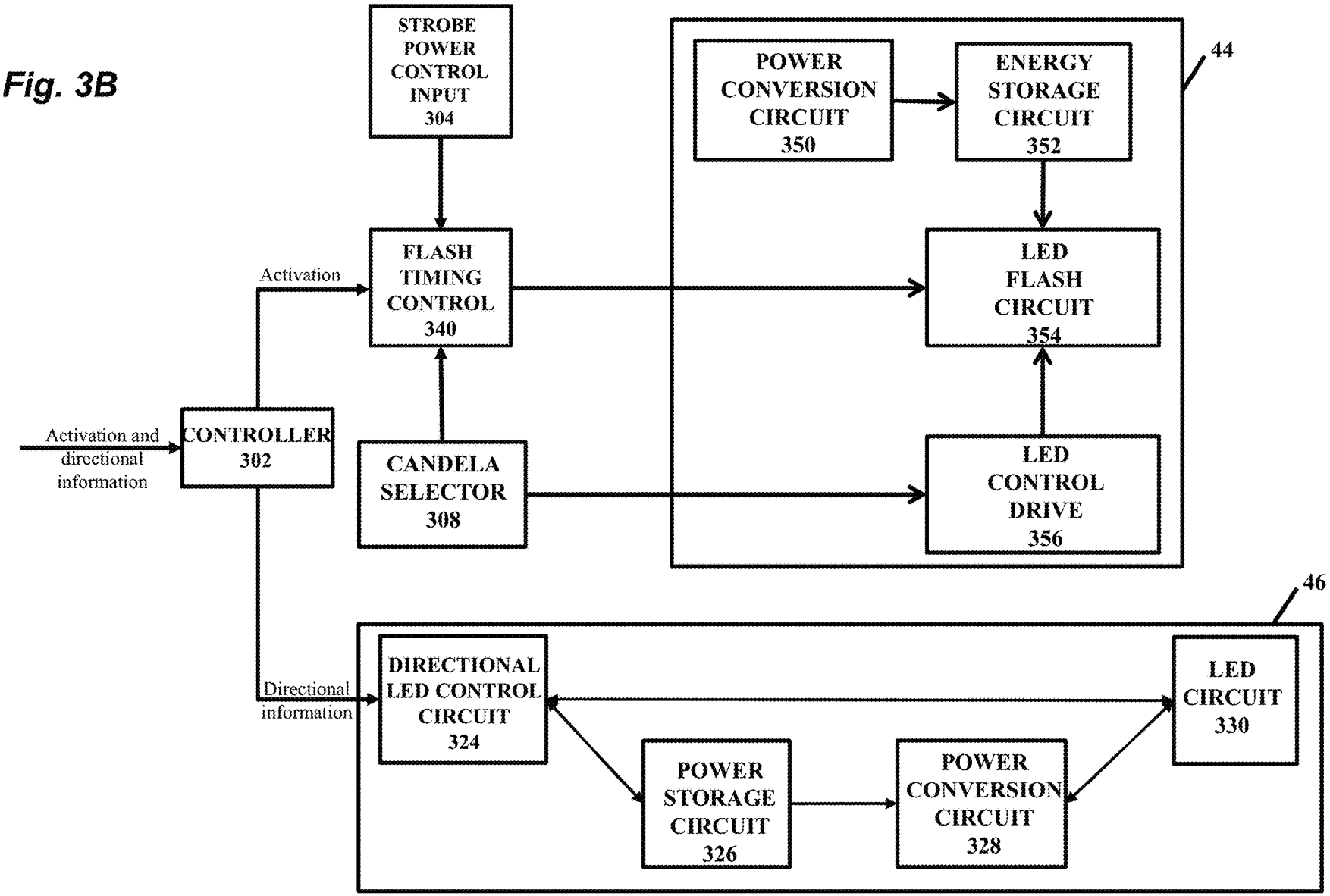
FIG. 3B illustrates another example of an expanded block diagram of the strobe notification appliance (including an LED strobe element and associated circuitry, and directional information element and associated circuitry) illustrated in FIG. 2A.

FIG. 3B illustrates another example of an expanded block diagram of the strobe notification appliance (including an LED strobe element and associated circuitry, and directional information element and associated circuitry 46) illustrated in FIG. 2A. In particular, FIG. 3B includes an LED flash circuit 354, a power conversion circuit 350, energy storage circuit 352, and LED control drive 356. The power conversion circuit 350 provides the proper regulated voltage to the energy storage circuit 352. An example of the power conversion circuit 350 may be a voltage regulator (such as a DC-DC converter or current regulator), and an example of the energy storage circuit 352 may be a capacitor. The flash timing control circuit 340 generates an output to the LED control drive 356. Based on the output, the LED control drive 356 provides the proper current to the LED flash circuit 354 in order for the LED flash circuit 354 to generate the desired intensity. Further, the flash timing control 340 generates an output to LED flash circuit 354, which dictates the duration of the output of the LED flash circuit 354. Thus, the flash timing control 340 may control both the intensity and the duration in order to generate an output with the requested candela rating (as dictated by candela selector 308). The flash timing control 340 further may communicate with the power conversion circuit 350 in order for the power conversion circuit 350 to provide the proper voltage to energy storage circuit 352.

Thus, upon receiving the activation signal (such as in the form of a command received by network interface 24), the power conversion circuit 350 may charge up the storage capacitor in energy storage circuit 352. When the strobe element is activated, the flash timing control 340 may initialize the power conversion circuit 350 to charge the energy storage circuit 352, as well as configure the LED control drive 356. This may be applicable to a notification appliance that is addressable. In a non-addressable notification appliance, the flash timing control may be set directly (such as locally on the non-addressable notification appliance).

Figure 3C:
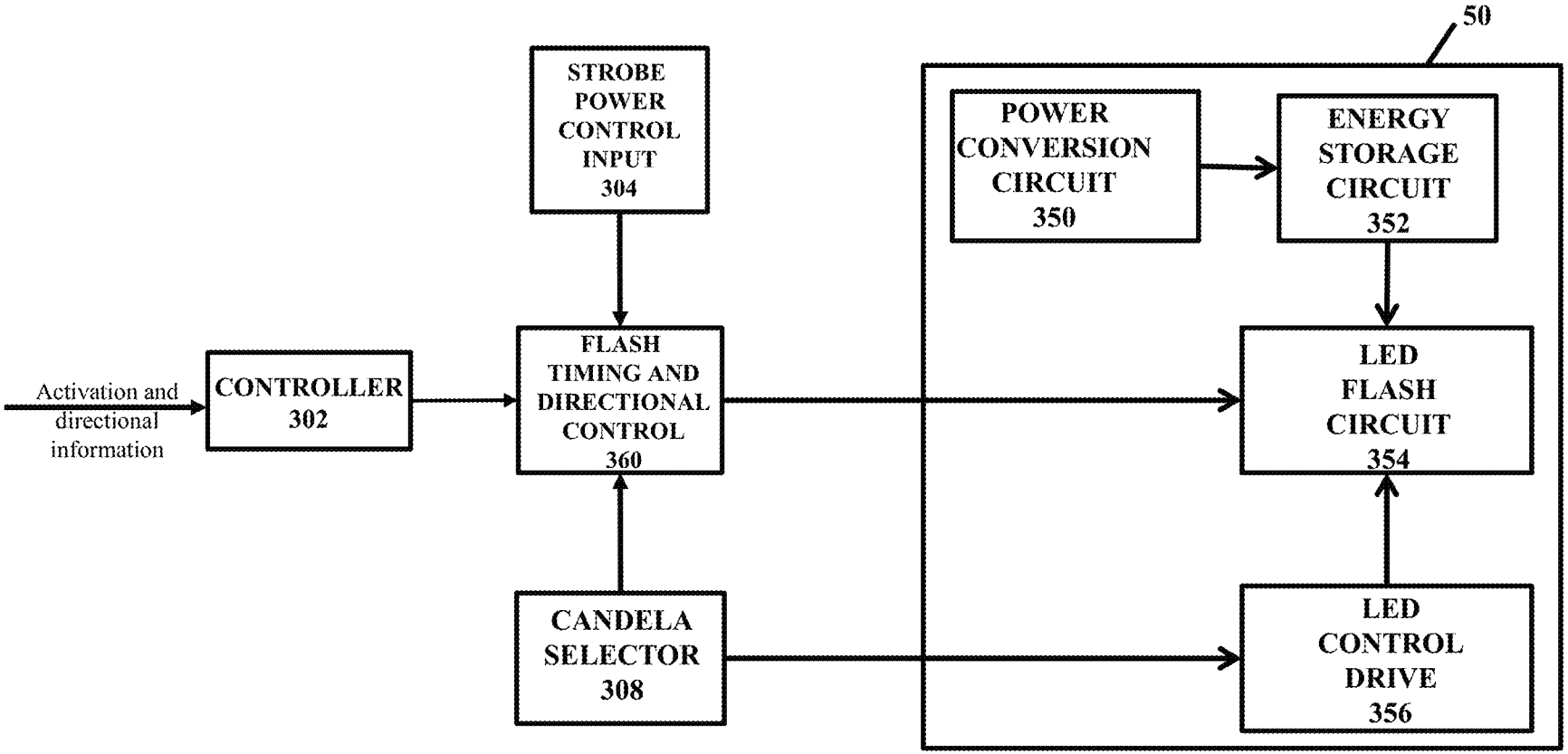
FIG. 3C illustrates one example of an expanded block diagram of the strobe notification appliance (including a strobe element and associated circuitry) illustrated in FIG. 2B.

FIG. 3C illustrates one example of an expanded block diagram of the strobe notification appliance (including a strobe element and associated circuitry) illustrated in FIG. 2B. Notification and directional information may be simultaneously output by the LED strobe element, as discussed above. In this regard, flash timing and directional control circuit 360 is configured to receive one or more signals from controller 302. In response to receipt of the one or more signals, flash timing and directional control circuit 360 controls LED flash circuit 354 in order to output the notification and directional information, as discussed above.

Figure 4:
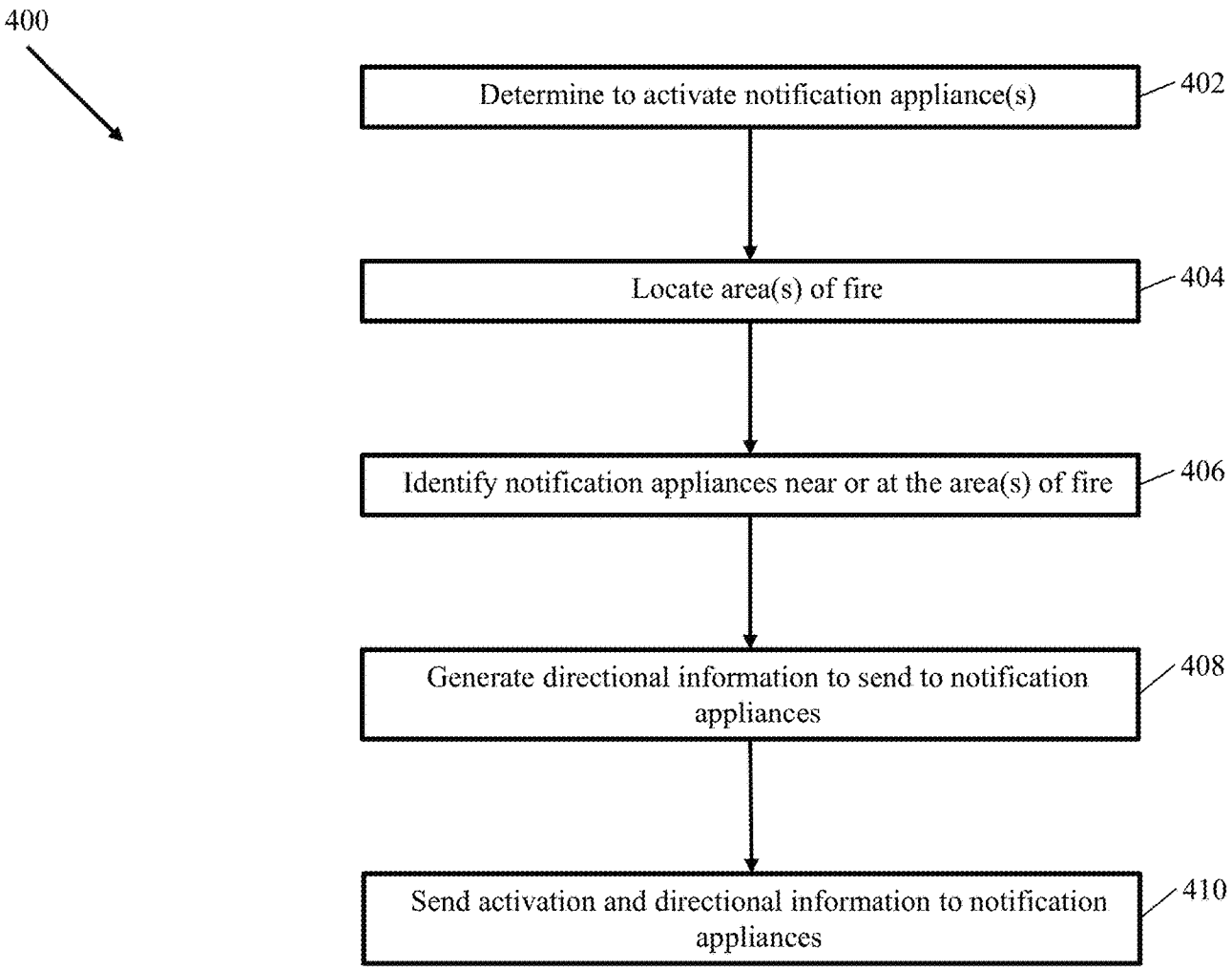
FIG. 4 is an exemplary flow chart of operation of the fire alarm panel in generating and sending the directional information to the strobe notification appliance.

FIG. 4 is an exemplary flow chart 400 of operation of the fire alarm panel in automatically generating and sending the directional information to the strobe notification appliance. At 402, the fire alarm panel determines whether to activate one or more of the notification appliances. As discussed above, the fire alarm panel may receive alarms or events from one or more sensors, such as fire alarm detectors, carbon monoxide detectors, heat sensors, or the like. Based on this information, the fire alarm panel may determine to activate one, some or all of the notification appliances under its control.

At 404, the fire alarm panel may locate the one or more areas of fire in the building. As one example, the fire alarm panel may determine which detectors, such as which fire alarm detectors or heat sensors, indicate areas of fire. At 406, based on the determined area(s) of fire, the fire alarm panel may determine which notification appliances are near or proximate to the determined area(s) of fire.

At 408, based on the identified notification appliances from 406, the fire alarm panel may generate directional information. As discussed above, the directional information may indicate a recommended path, may indicate a path to avoid, and/or may indicate to stay-in-place. In the instance of a fire alarm emergency, in one embodiment, the fire alarm panel may generate directional information to indicate to the occupant recommended path(s) to exit the building. In an alternate embodiment, the fire alarm panel may generate directional information to indicate to the occupant path(s) to avoid when exiting the building. In still an alternate embodiment, the fire alarm panel may generate directional information to indicate to the occupant recommended path(s) to exit the building and to indicate to the occupant path(s) to avoid when exiting the building. As discussed in more detail below, in other emergencies, the fire alarm panel may generate directional information, such as whether the occupant should stay-in-place and/or exit the building.

In one example, determination as to the preferred route(s) or disapproved route(s) may be based upon determined evacuation or other emergency responses for the building. The evacuation routes are known, and the programming for the appliances may be added to "configurable zones" that would indicate if a route was safe or not safe to use. In one particular example, smoke sensors may be associated with different evacuation routes. In response to the fire alarm panel determining that a particular smoke sensor was activated, the associated evacuation route may be deemed unsafe to use.

In another example, zones may be correlated to evacuation routes such that if a zone is in alarm, certain activation routes may be recommended. Programming the correlation may be performed manually, such as through programmed switches (e.g., physical switches or soft keys on a display (labeled for function) that are manually activated at the control panel).

At 410, the fire alarm panel sends the activation and directional information to the notification appliance(s). As discussed above, the activation and directional information may be sent in the same communication, or may be sent in separate communications to the notification appliance(s). Further, the activation and directional information may take several forms.

Alternatively, an authority having jurisdiction (AHJ), such as a firefighter, may provide input to fire alarm panel in order to determine the directional information to send to the notification appliances. The AHJ may thus determine the location of a fire, and based on this information, select directional information for a single notification appliance or for groups of notification appliances. In particular, the AHJ may individually select directional information for one, some, or all of the notification appliances in the system. Alternatively, the AHJ may input directional information that may be applied to a group of notification appliances. For example, when configuring the fire alarm system, the notification appliances may be grouped in virtual notification appliance circuits (VNAC), in which the notification appliances grouped in the VNAC are treated similarly. One example of a VNAC is illustrated in U.S. Pat. No. 8,378,806, incorporated by reference herein in its entirety. Upon the AHJ identifying directional information for a notification appliance (or a group of notification appliances), the fire alarm panel may assign all of the notification appliances in the VNAC similar directional information. In this way, the AHJ may provide manual input in order to determine directional information for groups of notification appliances.

Figure 5:
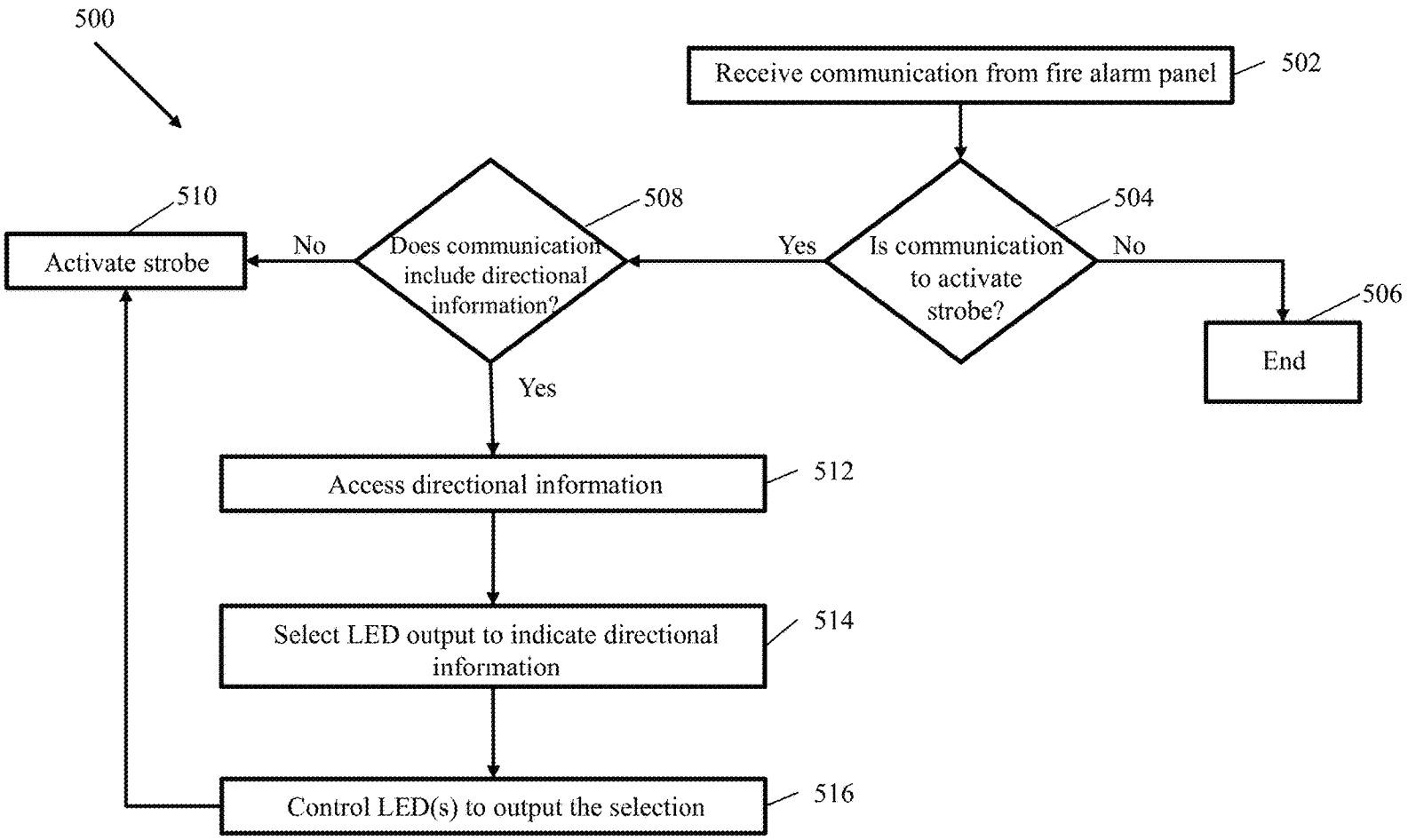
FIG. 5 is a first exemplary flow chart of operation of the fire alarm notification appliance to output the directional information separate from activating the strobe element of the strobe notification appliance.

FIG. 5 is a first exemplary flow chart 500 of operation of the fire alarm notification appliance to output the directional information separate from activating the strobe element of the strobe notification appliance. As discussed above, in one embodiment, the directional information may be output separately from the activation of the strobe element in the fire alarm notification appliance. For example, the fire alarm notification appliance may have two separate light output elements, such as a strobe element and another light output element. As discussed in more detail below with regard to FIG. 7B, the another light output element may comprise one or more LEDs.

At 502, the fire alarm notification appliance receives a communication from the fire alarm panel. At 504, the fire alarm notification appliance determines whether the communication is to activate the strobe element. If not, at 506, flow chart 500 ends. If so, at 508, the fire alarm notification appliance determines whether the communication includes directional information. As discussed above, the communication may include multiple fields, with one field indicative of activation and another field indicative of directional information. In this regard, the fire alarm notification appliance may search the different fields in the communication to determine whether the communication includes an indication to activate the strobe element and includes directional information. If no directional information is included in the communication, at 510, the fire alarm notification appliance activates the strobe element. If directional information is included in the communication, at 512, the fire alarm notification appliance accesses the directional information in the communication. The content of the directional information may be in one of several forms. In one example, the directional information may be indicative of a color to output (e.g., green, red, or yellow). In this regard, at 514, the fire alarm notification appliance may select the LED output to indicate the directional information. In the example of the directional information indicative of color, the fire alarm notification appliance may select the color of the LED to match the color as indicated by the directional information. At 516, the fire alarm notification appliance controls the LED(s) to output the selection. In particular, directional information indicative of red results in the fire alarm notification appliance selecting red to output on the LED. After which, the flow chart 500 loops to 510.

Figure 6:
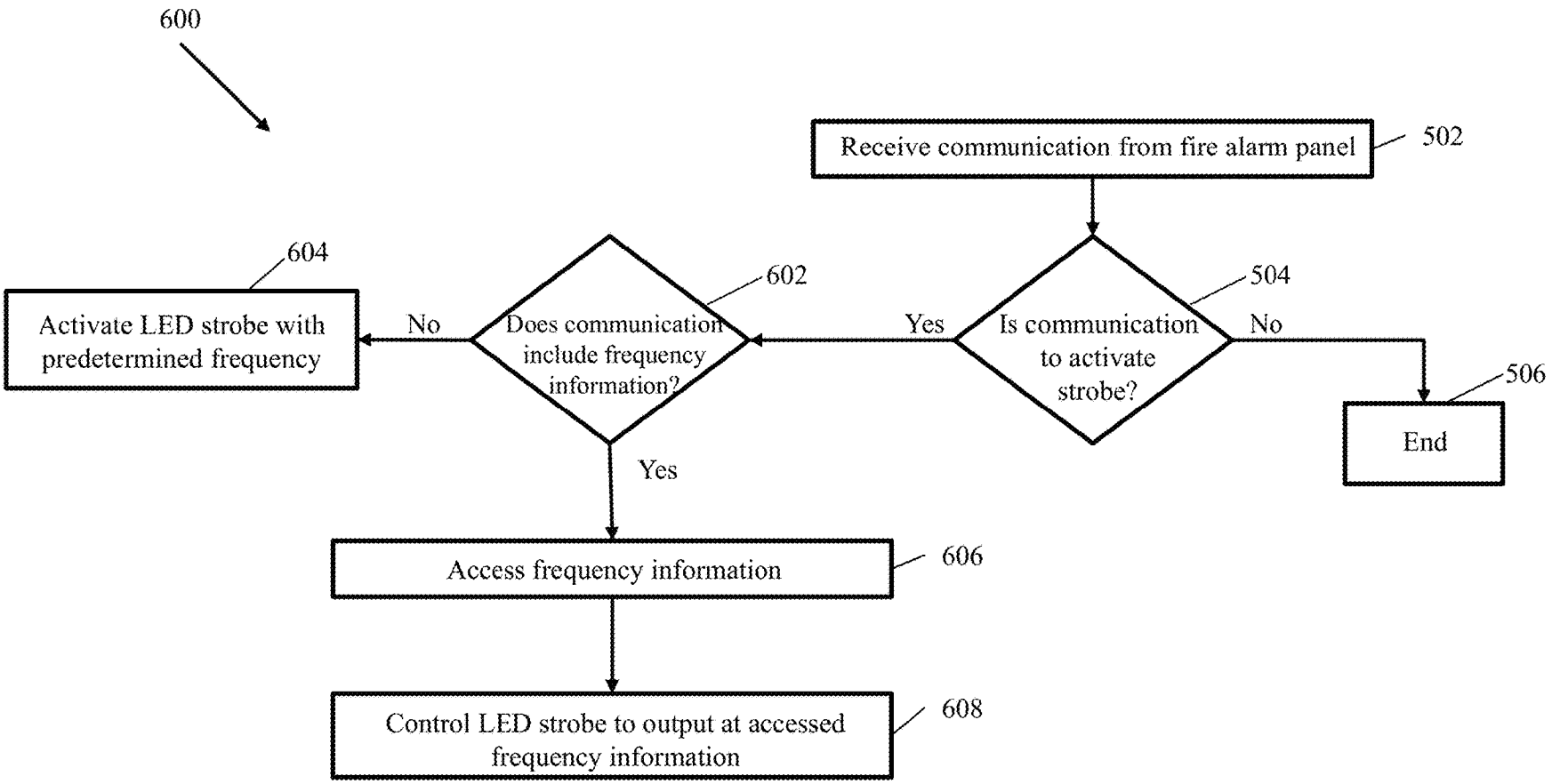
FIG. 6 is a second exemplary flow chart of operation of the fire alarm notification appliance to output the directional information in combination with activating the strobe element of the strobe notification appliance.

FIG. 6 is a second exemplary flow chart 600 of operation of the fire alarm notification appliance to output the directional information in combination with activating the strobe element of the strobe notification appliance. As discussed above, in one embodiment, the directional information may be output in combination with the activation of the strobe element in the fire alarm notification appliance. For example, the fire alarm notification appliance may control a single light output element (such as a strobe) in one or more aspects in order to output both the notification and directional information. Example aspects include frequency of the strobed output, timing of the strobed output, or the like. At 602, the fire alarm notification appliance determines whether the communication includes frequency information. If so, at 606, the fire alarm notification appliance accesses frequency information in the communication, and at 608, controls the LED strobe to output at the accessed frequency information. If not, at 604, the fire alarm notification appliance activates the LED strobe with a predetermined frequency.

As discussed above, various notification appliances may be used. Examples of notification appliances include, but are not limited to: fire alarm notification appliances; emergency notification appliances; and the like. FIG. 7A is a side view of a notification appliance 706 mounted to the wall 708. FIG. 7A further illustrates mounting box 702 and notification appliance backplate 704. The modular add-on appliance may include a backplate (not shown) that is installed on the original notification appliance backplate 704 or replace the original notification appliance backplate 704 before the notification appliance 706 would be mounted. FIG. 7A illustrates a notification appliance with a flash tube strobe element. Alternatively, the strobe element may comprise one or more LEDs, such as illustrated in FIG. 7B. Further, as illustrated in FIG. 7B, the modular add-on appliance backplate may contain one or more colored and/or multicolored indicators.

In one example, the retrofit may comprise an add-on indicator plate. The add-on indicator plate may include an electrical connector configured to electrically connect to one or more contacts on the previously installed notification appliance. In a specific example, the set of contacts may be exposed on an edge of the previously installed notification appliance, thereby allowing the electrical connection of the add-on indicator plate to the addressable signal line circuit within the existing appliance. Further, the add-on indicator plate may include a mechanical connector configured to mechanically connect to the previously installed notification appliance. The mechanical connector may comprise one or more screws to screw through a hole in the add-on indicator plate and affix to the previously installed notification appliance.

FIG. 7B illustrates an exemplary embodiment of the strobe notification appliance 740, which includes original notification appliance 750 and modular add-on appliance backplate 760. The original notification appliance 750 may include front housing 716, optic 718, LEDs 710, LED PCB 712, input devices 720, 722, and speaker 714. The input devices 720, 722 may be manually configurable. For example, the input devices 720, 722 may comprise manual switches (e.g., 2 position switches) in order for a technician to configure the notification appliance. As illustrated in FIG. 7B, the number of switches for input device 720 is different than the number of switches for input device 722. Alternatively, the number of switches for input device 720 may be the same as the number of switches for input device 722. In one embodiment, input device 720 may be for input of the address of the notification appliance, and input device 722 may be for input to configure the audio output, in the event that the notification appliance includes an audio output, such as a horn. In this regard, the controller of the notification appliance may poll both of input device 720, 722 in order to determine the address and the audio configuration of the notification appliance, respectively. Thereafter, the address and the audio configuration of the notification appliance may be stored in a memory within notification appliance and/or may be transmitted external to the notification appliance (e.g., to a fire alarm control panel responsive to a command from the fire alarm control panel querying the notification appliance).

FIG. 7B further illustrates modular add-on appliance backplate 760. Modular add-on appliance backplate 760 (similar to notification appliance backplate 704) may be connected to original notification appliance 750 in one of several ways. In one example, modular add-on appliance backplate 760 is connected to original notification appliance 750 via a plug 724 on the side of original notification appliance 750. Other connections are contemplated.

Modular add-on appliance backplate 760 includes one or more LEDs. FIG. 7B depicts four rows of LEDs, including on the left side of original notification appliance 750 (LEDs 752), on the right side of original notification appliance 750 (LEDs 756), on the bottom side of original notification appliance 750 (LEDs 754), and on the top side of original notification appliance 750 (LEDs 758). In this regard, LEDs 752 and LEDs 756 are on opposite sides of LEDs 710 of notification appliance 750. Similarly, LEDs 754 and LEDs 758 are on opposite sides of LEDs 710 of notification appliance 750. As discussed above, LEDs in 752, 754, 756, 758 may comprise single color LEDs or multi-color LEDs. In using single color LEDs, LEDs in 752, 754, 756, 758 may include different single color LEDs (e.g., red color LEDs, green color LEDs, etc.). Though FIG. 7B illustrates four separate rows of LEDs, other configurations are contemplated. For example, only one row of LEDs may be included (including one of 752, 754, 756, 758). Alternatively, only two rows of LEDs may be included (including, for example, 752 and 756, or 754 and 758). In yet another alternative, only three rows of LEDs may be included (including, for example, 752, 754, 756, or 752, 756, 758).

In one embodiment, all of the rows of LEDs 752, 754, 756, 758 output the same color for directional information. For example, in the event that the directional information indicates a clear path in a fire emergency, all of the LEDs in rows 752, 754, 756, 758 are green in color. As another example, in the event that the directional information indicates a blocked path in a fire emergency, all of the LEDs in rows 752, 754, 756, 758 are red in color. In this regard, when an occupant is faced with a first path and a second path, with the first path having notification appliance with LEDs green in color and the second path having notification appliance with LEDs red in color, the occupant may select the first path to exit the building.

In still another example, in the event that the directional information indicates to stay-in-place or shelter in an emergency (such as a hostile intruder, a weather emergency, a bomb threat, or the like), all of the LEDs in rows 752, 754, 756, 758 are yellow in color.

In still another embodiment, the rows of LEDs 752, 754, 756, 758 output different colors to convey different directional information. For example, in the event that the exit to the left is blocked and the exit to the right is clear, the LEDs in row 752 (on the left of the notification appliance 740) output the color red and the LEDs in row 756 (on the right of the notification appliance 740) output the color green. In this way, occupants may be notified to exit to the right.

As discussed above, the emergency lighting appliances may be used to communicate directional information. As one example, the output of the emergency light, in and of itself, may be indicative of communicating directional information. As one example, the light of the emergency lighting appliance may flash (which is in contrast to the ordinary operation of the light being constantly on when power is lost), which may be indicative of directional information to the occupants of the building (e.g., the flashing may be indicative of the path to safety). As another example, the output of the emergency light, in combination with output from another notification appliance, may be indicative of communicating directional information. As one example, the light of the emergency lighting appliance may be operated in a mode that is constantly-on, which is the same as the ordinary operation when power is lost. Because only a subset of the emergency lighting appliances are activated (such as to indicate a path to a particular stairwell) and in combination with a fire notification appliance flashing its light, the constant-on light of the emergency lighting appliance may be indicative of directional information to the occupants of the building (e.g., the constant on of the emergency lighting appliances may be indicative of the path to safety). As another example, because only a subset of the emergency lighting appliances are activated (such as to indicate a path to a designated shelter area) and in combination with a mass notification appliance flashing its light, the constant-on light of the emergency lighting appliance may be indicative of directional information to the occupants of the building (e.g., the constant on of the emergency lighting appliances may be indicative of the path to the designated shelter area).

Thus, in one implementation, the lights of the emergency lighting appliances may have a unique flashing pattern to indicate directional information. For example, the lights of the emergency lighting appliances may flash in order to indicate a path for the occupants.

As another example, the lights of the emergency lighting appliances may flash in a sequence (such as similar to runway landing lights) in order to guide occupants to an exit. In particular, a series of emergency lighting appliances may be along a corridor to an exit. The start of activation of the light in the series of emergency lighting appliances may be timed such as to give a cascading effect toward the exit. In a more specific example, three emergency lighting appliances may be positioned in a corridor that has an exit, with the first emergency lighting appliance furthest from the exit, the second emergency lighting appliance closer to the exit, and the third emergency lighting appliances closest to the exit. The activation of the lights on the first, second and third emergency lighting appliances may be timed such that the light on the first emergency lighting appliance is activated first (e.g., at time t=X seconds), the strobe element on the second emergency lighting appliance is activated second (e.g., at time t=X+1 second), and the strobe element on the third emergency lighting appliance is activated third (e.g., at time t=X+2 second). In the example of the lights on each of the first, second, and third emergency lighting appliances being activated for the same pulse width (e.g., 200 mS or 300 mS in a 1-second cycle), the occupant viewing the cascading activation of the lights may be guided toward the exit. Likewise, the activation of the lights on the first, second and third emergency lighting appliances may be timed such that the light on the third emergency lighting appliance is activated first (e.g., at time t=X seconds), the light on the second emergency lighting appliance is activated second (e.g., at time t=X+1 second), and the light on the first emergency lighting appliance is activated third (e.g., at time t=X+2 second), thereby giving the effect of guiding the occupant away from the exit.

The emergency lighting appliances may be notified when to activate its respective light in one of several ways. In one way, the control panel may send the activation command with the timing information included. For example, the command may include fields correlating the emergency lighting appliance's address with the timing information. In the example above, the first emergency lighting appliance may be assigned address 0001, the second emergency lighting appliance may be assigned address 0002, and the third emergency lighting appliance may be assigned address 0003. The control panel may generate a command that includes the following information correlated to the addresses: 0001: 0; 0002: 1.0; 0003: 2.0. In this regard, a respective emergency lighting appliance may access its address (stored locally within the respective emergency lighting appliance), and determine the timing information. In another way, the control panel may cascade the sending the activation command according to the timing information. For example, the control panel may broadcast a first command (with the address for the first emergency lighting appliance and indicative to activate the respective light of the first emergency lighting appliance) at time t=X, may broadcast a second command (with the address for the second emergency lighting appliance and indicative to activate the light of the second emergency lighting appliance) at time t=X+1 second, and may broadcast a third command (with the address for the third emergency lighting appliance and indicative to activate the light of the third emergency lighting appliance) at time t=X+2 second. In practice, the respective emergency lighting appliance may receive the broadcast commands, determine whether the command includes the address of the respective emergency lighting appliance, and activate the light in response to determining that an activation command is addressed to it. In this way, staggering the sending of the commands may likewise stagger the timing of the activation of the lights.

Figure 8A:
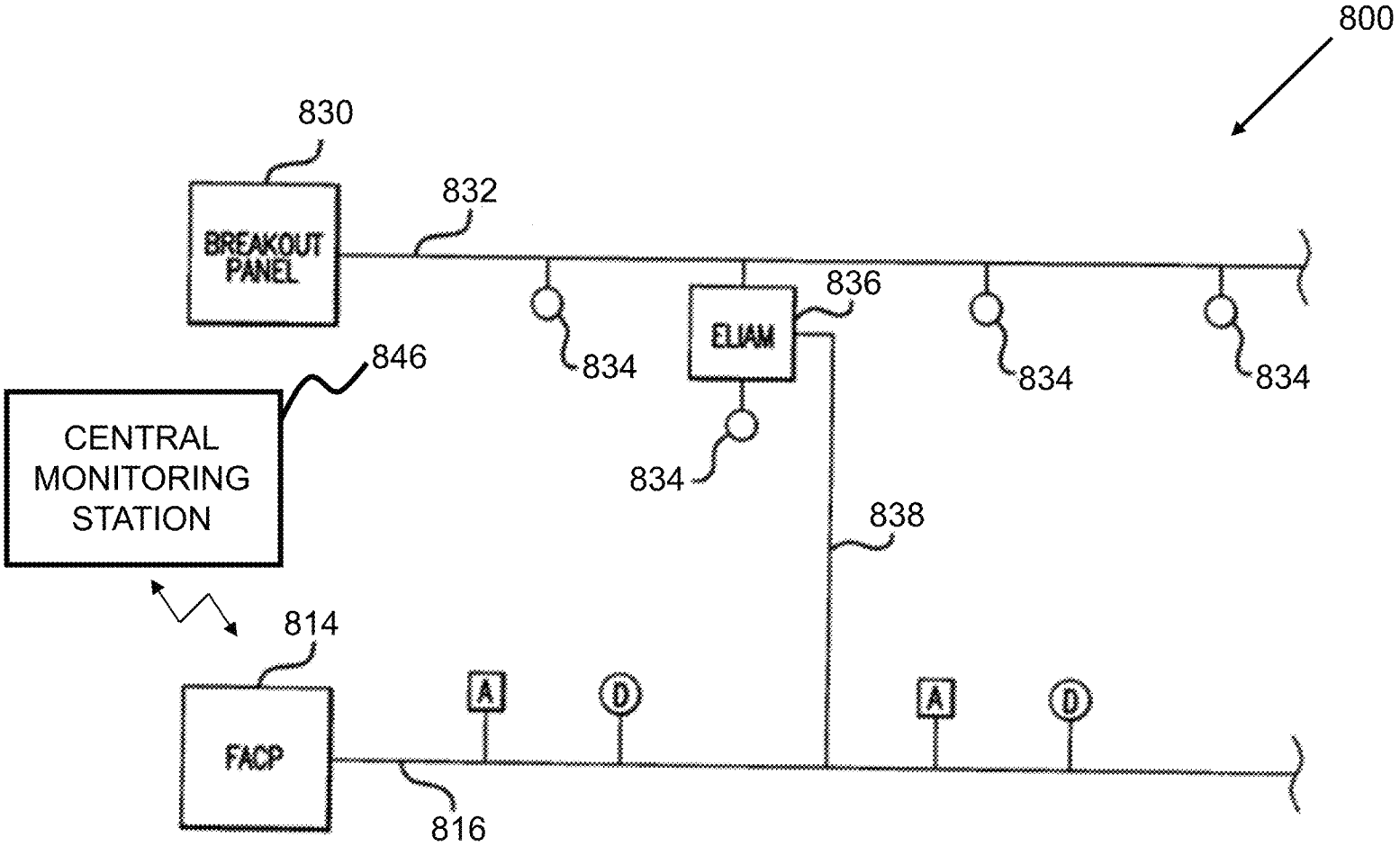
FIG. 8A is a schematic diagram illustrating an emergency lighting system.

FIG. 8A is a schematic diagram illustrating a safety system 800, which may include alarm condition detectors D, alarm system notification appliances A, and emergency lights. One, some or all of the emergency lighting appliances may be addressable modules within the fire alarm system and may communicate with a system controller over an addressable loop, or signaling line circuit (SLC), e.g., a fire alarm network. An example system including emergency lighting appliances is disclosed in U.S. Pat. No. 7,999,666, incorporated by reference herein in its entirety.

The emergency lighting appliance may be referred to as an Emergency Lighting Individual Addressable Module (ELIAM). According to one implementation, ELIAMs may co-exist with other fire alarm peripherals, e.g., strobe notification appliances, smoke detectors, pull stations, etc. Each SLC is rated to allow the monitor and control of a certain number of addressable modules. For example, one SLC may allow 250 modules on a single SLC, thirty of which may be ELIAMS. A system may have multiple SLCs. For example, the system of FIG. 1 has two SLCs 16. A particular SLC may be designed to support a given number of ELIAMs, which may represent full or partial SLC capacity. For illustrative purposes only, just one SLC 816 is shown, and the single line represents the two wires 18 and 20 of FIG. 1. Thus, in one implementation, the ELIAMs may be on the same SLC as the fire notification appliances or mass notification appliances. Alternatively, the ELIAMs may be on a separate SLC from the fire notification appliances or mass notification appliances. In a separate implementation, instead of an SLC, the appliances may be connected to a Notification Appliance Circuit (NAC). In contrast to an SLC, the NAC, discussed below with regard to FIG. 8D, may generate more power to power the notification appliances, such as the fire notification appliances and mass notification appliances.

A breakout panel 830 supplies power over power line 832 to one or more lights (such as lamp 834), some of which may be designated for emergency lighting. According to one implementation illustrated in FIG. 8A, an ELIAM 836 is attached between the lighting power line 832 and a lamp 834. According to an alternate implementation illustrated in FIG. 8B, an ELIAM 850 (which include a lamp 834) is attached to the lighting power line 832. The fire alarm network is extended to the ELIAM 836, 850 via connection 838 to fire alarm network. The ELIAM 836, 850 thus appears to the control panel (system controller) 814 as another network appliance, and can be controlled by, and report to, the control panel 814. For example, the control panel 814 may send one or more commands to the ELIAM 836, 850, as discussed further below. Further, the control panel 814 may compile reports, and may send the reports to a central monitoring station 846. Though not illustrated in FIG. 8B, ELIAM 850 may generate an audible output, such as via a speaker. For example, ELIAM 850 may generate a predetermined output, such as a chirp, to indicate, separate from the light output from lamp 834, a direction to the determined egress. The predetermined output from the ELIAM 850 may be coordinated with an audible output from a fire notification appliance or mass notification appliance proximate to the ELIAM 850.

Figure 8B:
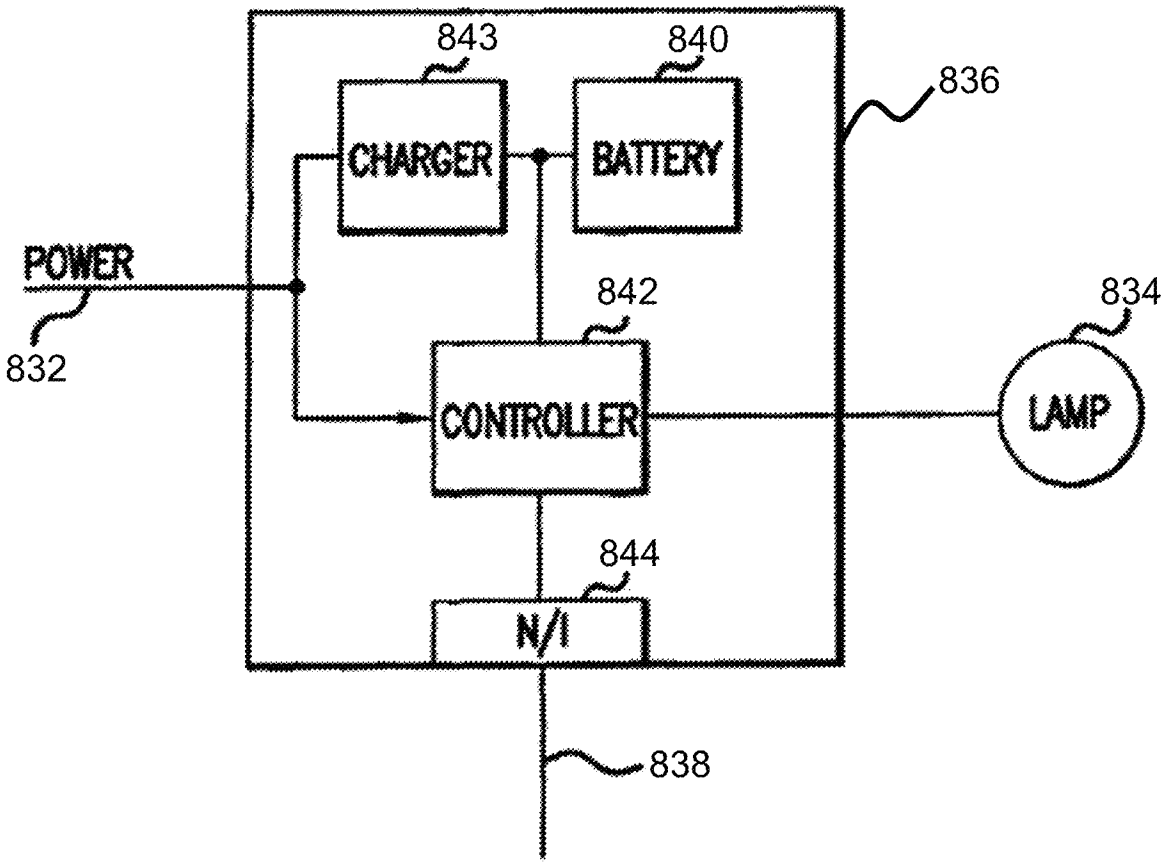
FIG. 8B is a block diagram illustrating a first example of an Emergency Lighting Individual Addressable Module (ELIAM).
Figure 8C:
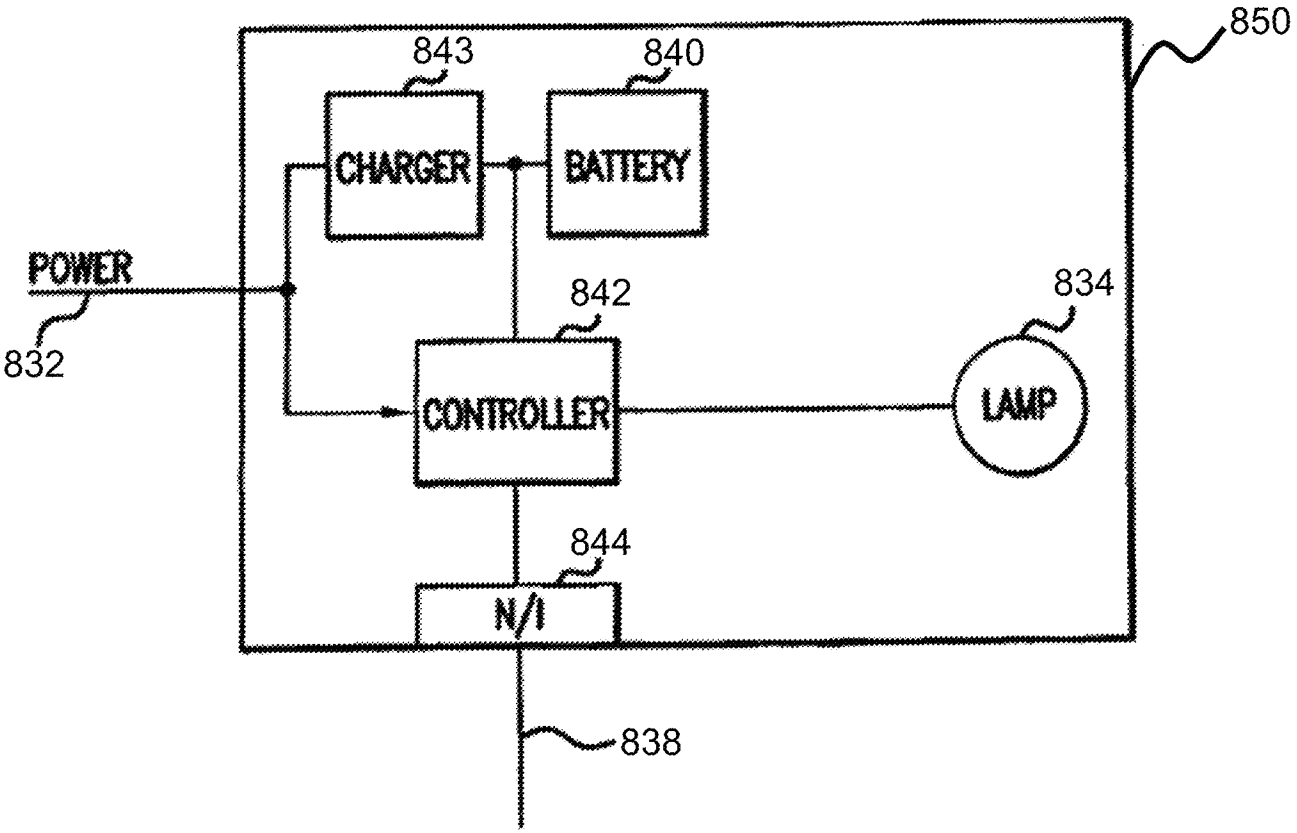
FIG. 8C is a block diagram illustrating a second example of an ELIAM in which the ELIAM includes a lamp.

FIG. 8B is a block diagram illustrating a first example of an ELIAM 836. Power is received through power line 832 and is normally routed to power lamp 834. In the event of an AC power loss, a controller 842 causes the lamp 834 to be powered from the backup battery 840. A network interface 844, which is one example of a communication interface, connects the unit to the fire alarm network 838. Upon receiving a command via the network interface 844 from the system controller 814, the ELIAM controller 842 disconnects the lamp 834 from the power line 832 and instead causes the lamp 834 to be powered from the backup battery 840. Since the ELIAM 836 is identified by its system address, a custom label, such as a textual description, can be assigned to the point. FIG. 8C is a block diagram illustrating a second example of an ELIAM 850 in which the ELIAM 850 includes a lamp 834.

Figure 8D:
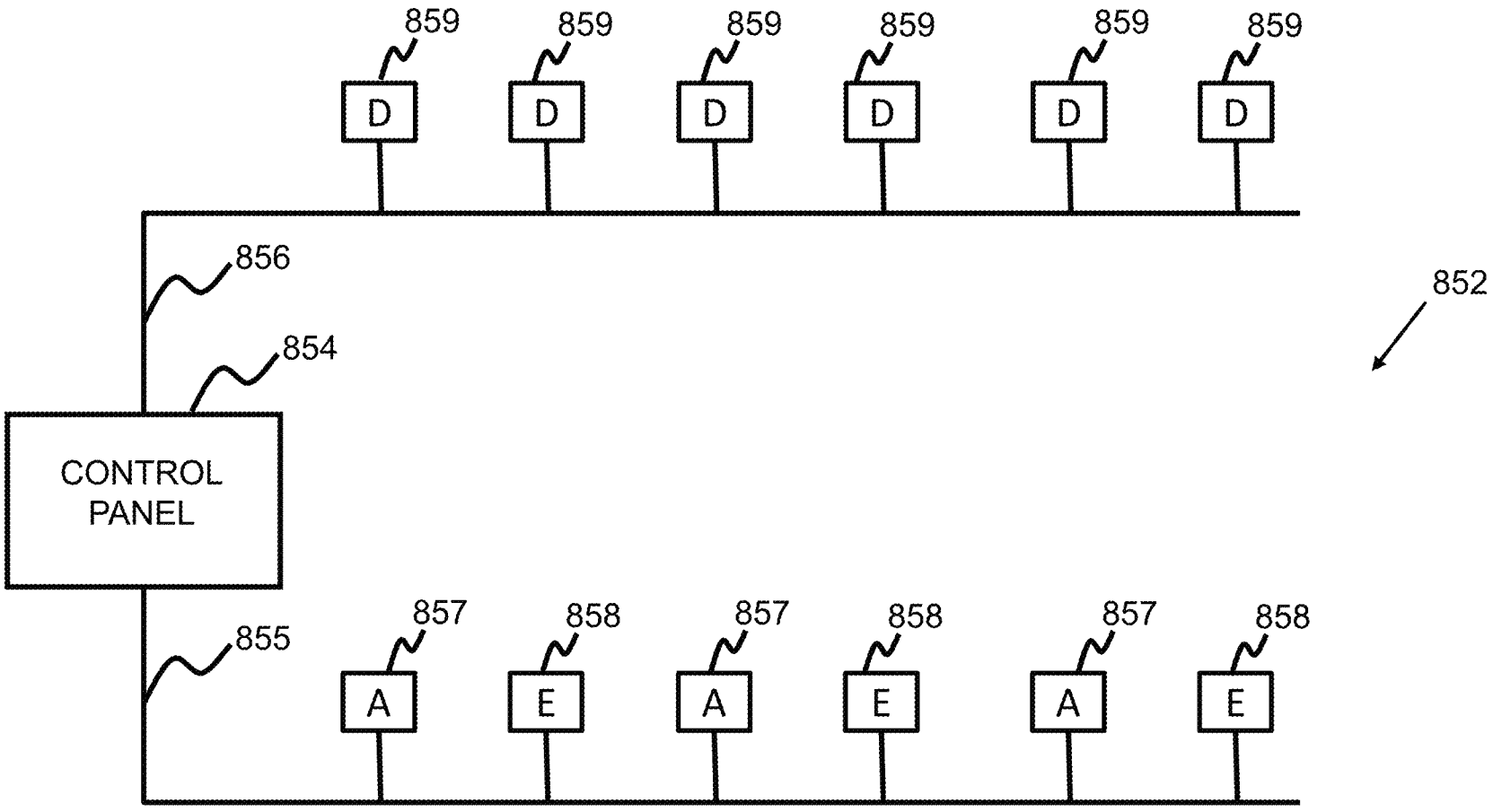
FIG. 8D is a block diagram in which detectors are wired on a signaling line circuit (SLC) and the notification appliances/emergency lighting appliances are wired on a notification appliance circuit (NAC).

FIG. 8D is a block diagram 852 in which detectors D (859) are wired on an SLC 856 and the notification appliances A (857)/emergency lighting appliances E (858) are wired on a notification appliance circuit (NAC) 855. The NAC 855 may connect the notification appliances to the fire alarm control panel, such as discussed in U.S. Pat. No. 8,558,711, incorporated by reference herein in its entirety. Further, control panel 854 may comprise a fire alarm control panel.

Figure 8E:
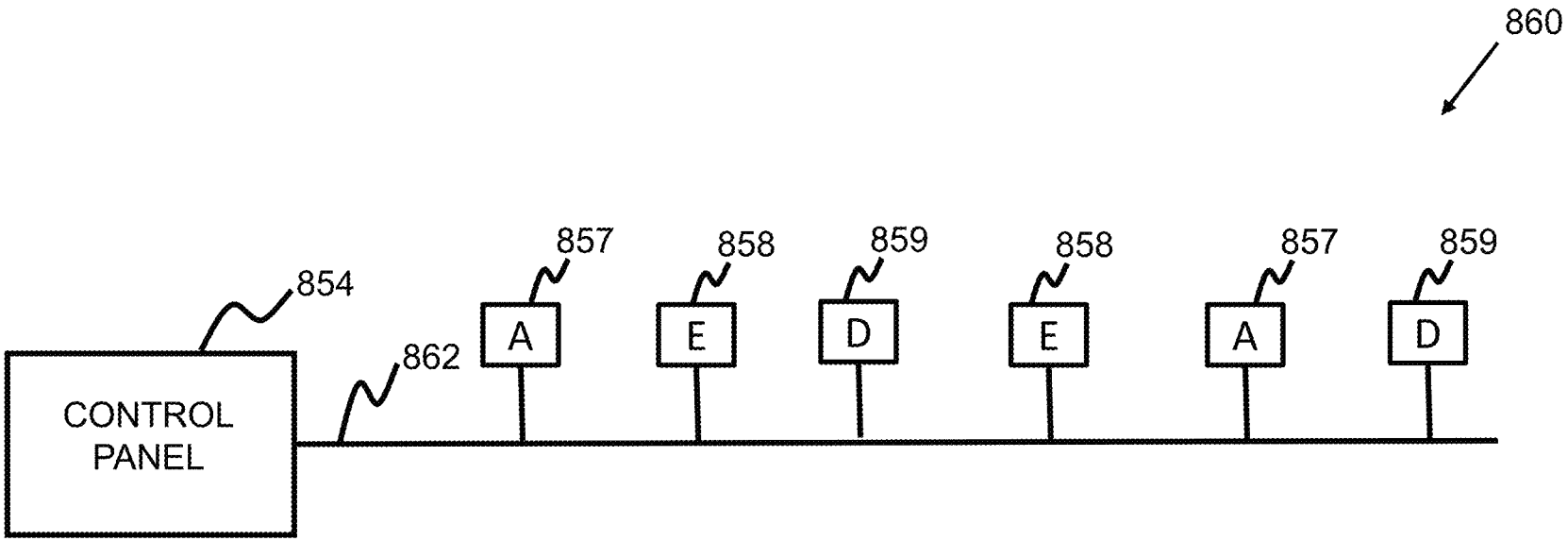
FIG. 8E is a block diagram in which detectors, notification appliances and emergency lighting appliances are wired on an SLC.

FIG. 8E is a block diagram 860 in which detectors D (859), notification appliances A (857) and emergency lighting appliances E (858) are wired on an SLC 862.

Figure 8F:
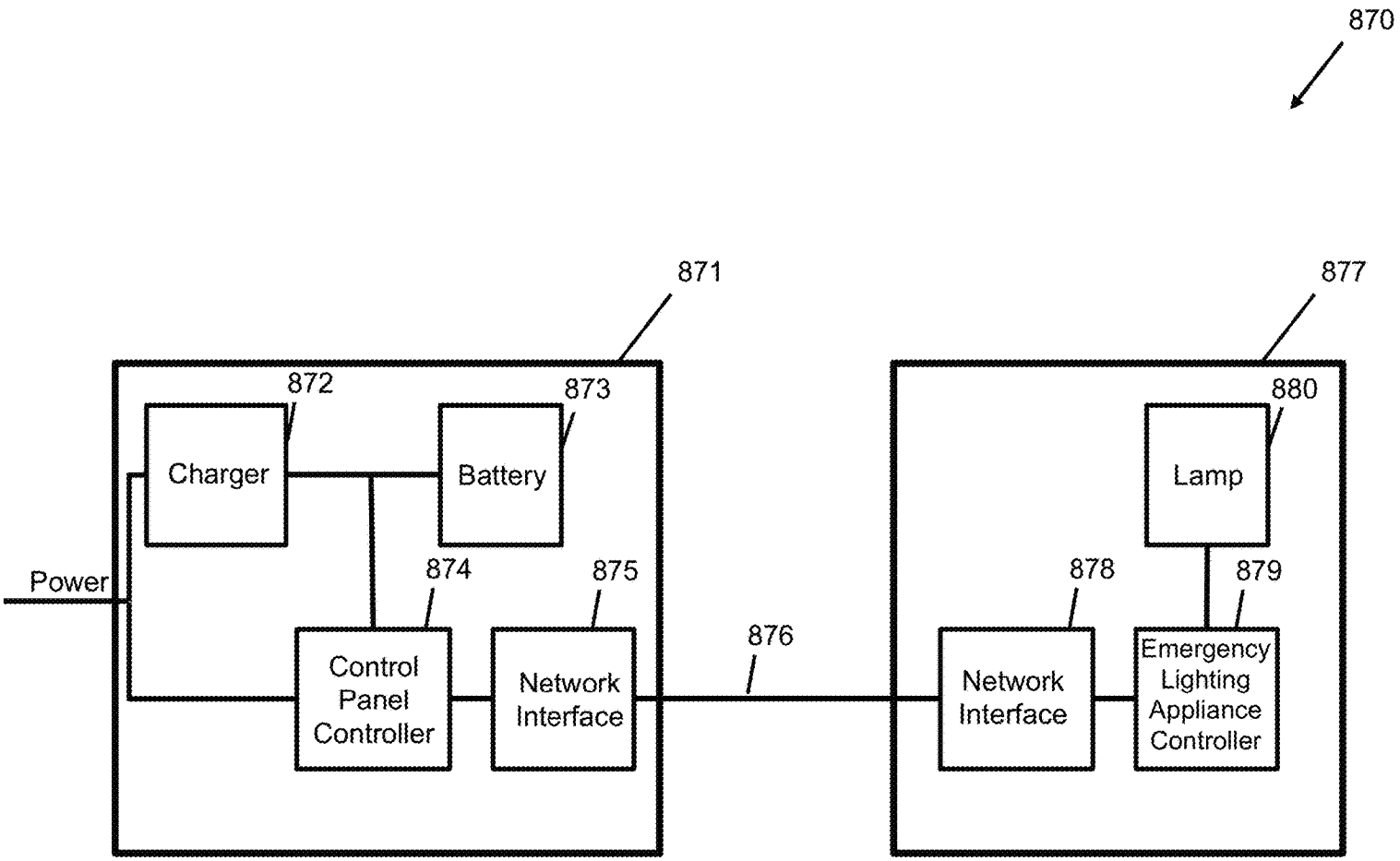
FIG. 8F is a block diagram of a control panel and an emergency lighting appliance.

FIG. 8F is a block diagram 870 of a control panel 871 and an emergency lighting appliance 877. Though only one emergency lighting appliance 877 is illustrated, multiple emergency lighting appliances 877 are contemplated. Further, one or more notification appliances may be connected to line 876 as well. The control panel 871 may receive power, such as illustrated in FIG. 8F. Further, control panel 871 may include a control panel controller 874, a charger 872, a battery 873, and a network interface 875. The control panel controller 874 may be configured to control the notification system and/or the emergency lighting system. In this regard, control panel controller 874 may be configured to perform the functionality disclosed in FIG. 10, discussed in further detail below. The battery 873 may be charged via charger 872 in order to provide power to one or more emergency lighting appliances 877. The power may be provided via line 876 to the emergency lighting appliance 877. Though FIG. 8F illustrates a single line 876, one or more lines may be used for communication, power, and the like. In this regard, one or more commands may be sent from control panel controller 874 of control panel 871 via network interface 876 to emergency lighting appliance 877. Alternatively, a line dedicated to providing power to emergency lighting appliance 877 may not be connected to network interface 875. Thus, as shown in FIG. 8F (and further in FIG. 8G), the battery is located centrally (in the control panel 871) and the battery is not located in emergency lighting appliance 877. In this way, the design of emergency lighting appliance 877 is simplified with power being provided via line 876 (or a dedicated power line).

Emergency lighting appliance 877 may include a network interface 878, an emergency lighting appliance controller 879, and a lamp 880. The network interface 878 may receive the one or more commands sent from control panel 871. The emergency lighting appliance controller 879 may process the commands in order to control lamp 880.

Figure 8G:
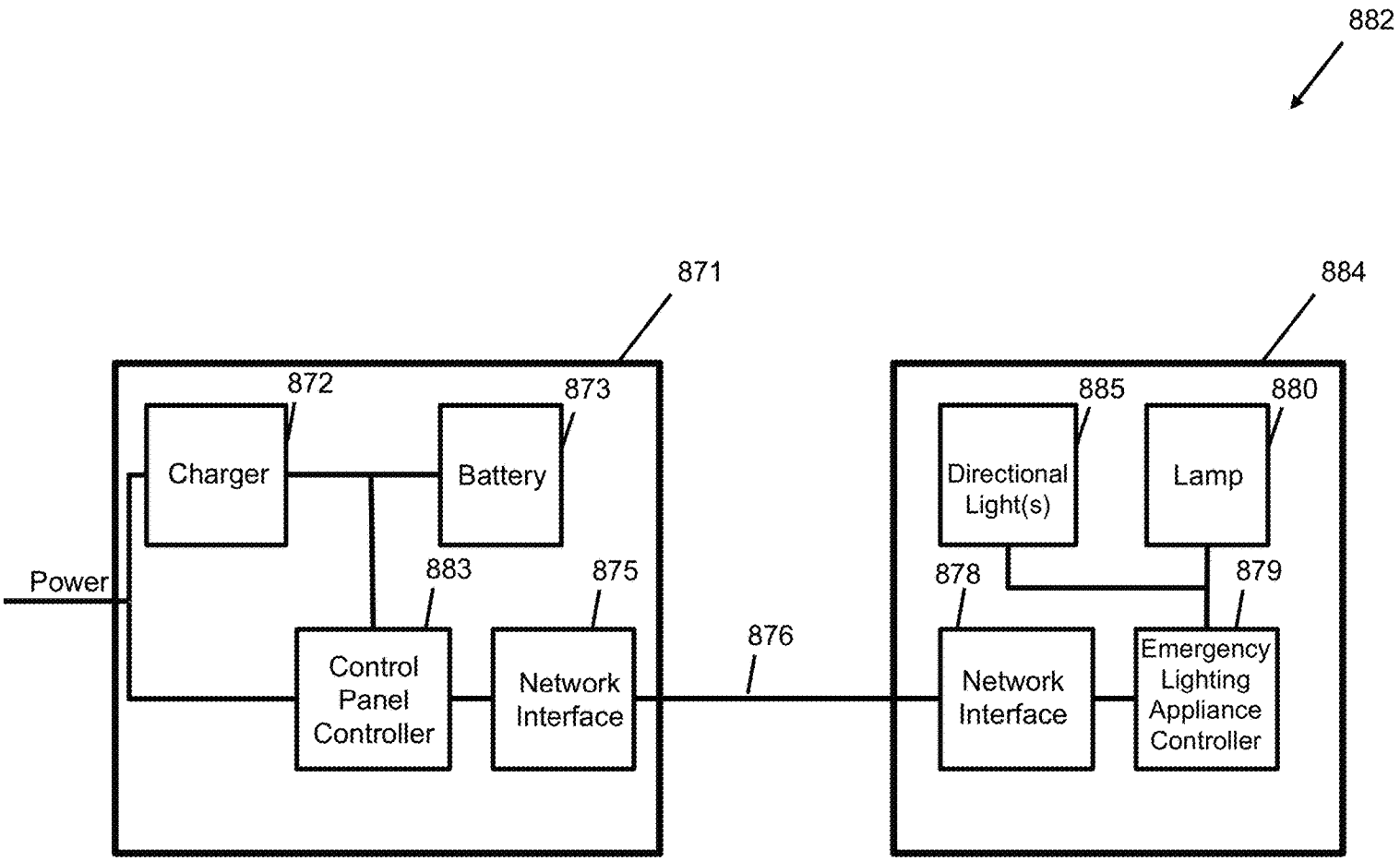
FIG. 8G is a block diagram of a control panel 871 and an emergency lighting appliance with two lights, including a lamp and one or more lights to output directional information.

FIG. 8G is a block diagram 882 of a control panel 871 and an emergency lighting appliance 884 with two lights, including a lamp 880 and one or more lights 885 to output directional information. In this regard, the emergency lighting appliance 884 in FIG. 8G differs from the emergency lighting appliance 877 in FIG. 8F in that the emergency lighting appliance 884 in FIG. 8G includes a separate light (or lights) to output directional information. Thus, control panel controller 883 may be configured to provide one or more fields in the one or more commands sent to emergency lighting appliance 884 in order for the emergency lighting appliance controller 879 to control directional light(s) 885.

The directional light(s) 885 may take one of several form. One form is disclosed in FIG. 8H, which is a front view 886 of an emergency lighting appliance 887 with two lights, including one or more lamps 888 and one or more lights to output directional information 890, 891, 892, 893. As shown, one or more lights, such as incandescent lights or LEDs, may be positioned on different sides of emergency lighting appliance 887. For example, the light(s) may be positioned on opposite sides, such as left 890 and right 892, or top 893 and bottom 891. The lights 890, 891, 892, 893 may be multi-color LEDs. For example, the multi-color LEDs may be configured to output green color, red color, etc. Alternatively, the one or more LEDs may be single color LEDs. For example, the one or more LEDs may comprise a first set of LEDs of a first single color (e.g., red LEDs), a second set of LEDs of a second single color (e.g., green LEDs), a third set of LEDs of a third single color (e.g., yellow LEDs), etc. In one embodiment, only a single set of LEDs is activated as a single time (e.g., only the red LEDs are activated). In an alternate embodiment, multiple sets of LEDs may be activated simultaneously. A first color (e.g., red) may be activated on the left side of the notification appliance while a second color (e.g., green) may be activated on the right side of the notification appliance. In this way, occupants may be notified to exit to the right.

Lights 890, 891, 892, 893 may be part of a modular add-on 887 to emergency lighting appliance 887. In one example, the modular add-on 887 may be used as a retrofit. The modular add-on 887 may include an electrical connector configured to electrically connect to one or more contacts on the emergency lighting appliance 887. In a specific example, the set of contacts may be exposed on an edge of the previously installed emergency lighting appliance 887, thereby allowing the electrical connection of the modular add-on 887 to the addressable signal line circuit within the existing appliance. Further, the modular add-on 887 may include a mechanical connector configured to mechanically connect to the previously installed emergency lighting appliance 887. The mechanical connector may comprise one or more screws to screw through a hole in the modular add-on 887 and affix to the previously installed emergency lighting appliance 887.

Figure 8H:
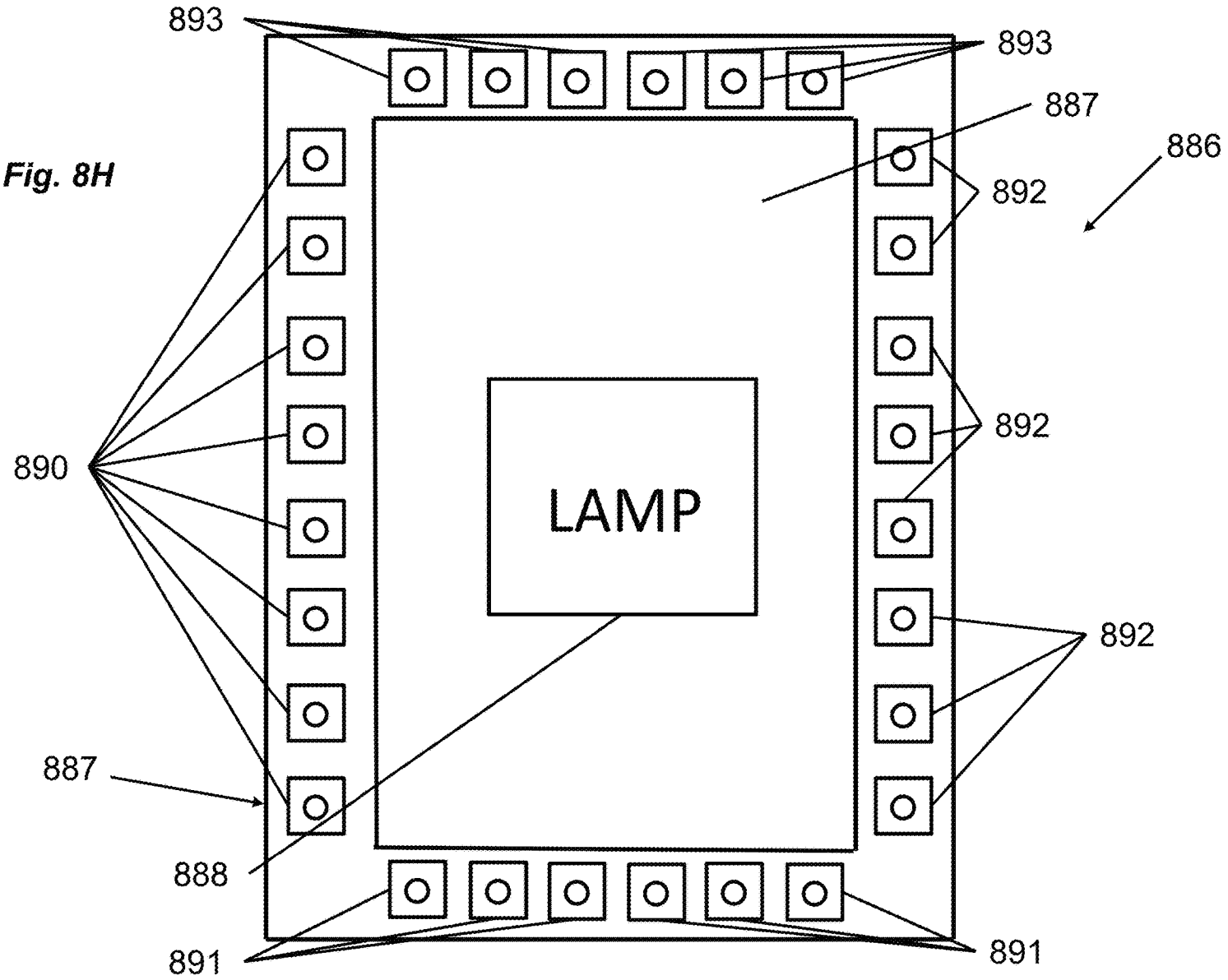
FIG. 8H is a front view of an emergency lighting appliance with two lights, including one or more lamps and one or more lights to output directional information.

Thus, FIG. 8H depicts four rows of LEDs, including on the left side of original emergency lighting appliance 887 (LEDs 890), on the right side of original emergency lighting appliance 887 (LEDs 892), on the bottom side of original emergency lighting appliance 887 (LEDs 891), and on the top side of original emergency lighting appliance 887 (LEDs 893). In this regard, LEDs 890 and LEDs 892 are on opposite sides of emergency lighting appliance 887. Similarly, LEDs 891 and LEDs 893 are on opposite sides of emergency lighting appliance 887. As discussed above, LEDs in 890, 891, 892, 893 may comprise single color LEDs or multi-color LEDs. In using single color LEDs, LEDs in 890, 891, 892, 893 may include different single color LEDs (e.g., red color LEDs, green color LEDs, etc.). Though FIG. 8H illustrates four separate rows of LEDs, other configurations are contemplated. For example, only one row of LEDs may be included (including one of 890, 891, 892, 893). Alternatively, only two rows of LEDs may be included (including, for example, 890 and 892, or 891 and 893). In yet another alternative, only three rows of LEDs may be included (including, for example, 890, 891, 892, or 890, 892, 893).

In one embodiment, all of the rows of LEDs 890, 891, 892, 893 output the same color for directional information. For example, in the event that the directional information indicates a clear path in an alarm event (e.g., a fire emergency), all of the LEDs in rows 890, 891, 892, 893 are green in color. As another example, in the event that the directional information indicates a blocked path in an alarm event, all of the LEDs in rows 890, 891, 892, 893 are red in color. In this regard, when an occupant is faced with a first path and a second path, with the first path having notification appliance with LEDs green in color and the second path having notification appliance with LEDs red in color, the occupant may select the first path to exit the building.

In still another example, in the event that the directional information indicates to stay-in-place or shelter in an emergency (such as a hostile intruder, a weather emergency, a bomb threat, or the like), all of the LEDs in rows 890, 891, 892, 893 are yellow in color.

In still another embodiment, the rows of LEDs 890, 891, 892, 893 output different colors to convey different directional information. For example, in the event that the exit to the left is blocked and the exit to the right is clear, the LEDs in row 890 (on the left of the emergency lighting appliance 887) output the color red and the LEDs in row 892 (on the right of the emergency lighting appliance 887) output the color green. In this way, occupants may be notified to exit to the right.

In this regard, FIG. 8H illustrates a communication interface, a first light emitting element configured to output light to illuminate a premises (lamp 888), and one or more second light emitting elements configured to output light indicative of directional information (LEDs 890, 891, 892, 893). Further, a controller, such as emergency lighting appliance controller 879, may be in communication with the communication interface, the first light emitting element, and the one or more second light emitting elements. Further, the controller may be configured to: receive, via the communication interface, an indication to activate the emergency lighting appliance; and in response to receiving the indication: control the first light emitting element in order for the first light emitting element to output the light to illuminate the premises; and control the one or more second light emitting elements in order for the second light emitting elements to output the light indicative of the directional information, the directional information configured to convey at least one of a direction for an occupant to go, a direction for the occupant not to go, or an indication to stay in place. In addition, the light to illuminate the premises and the light indicative of the directional information may be output simultaneously, and the light indicative of directional information is visible to an occupant separate from the light to illuminate a premises.

Figure 9:
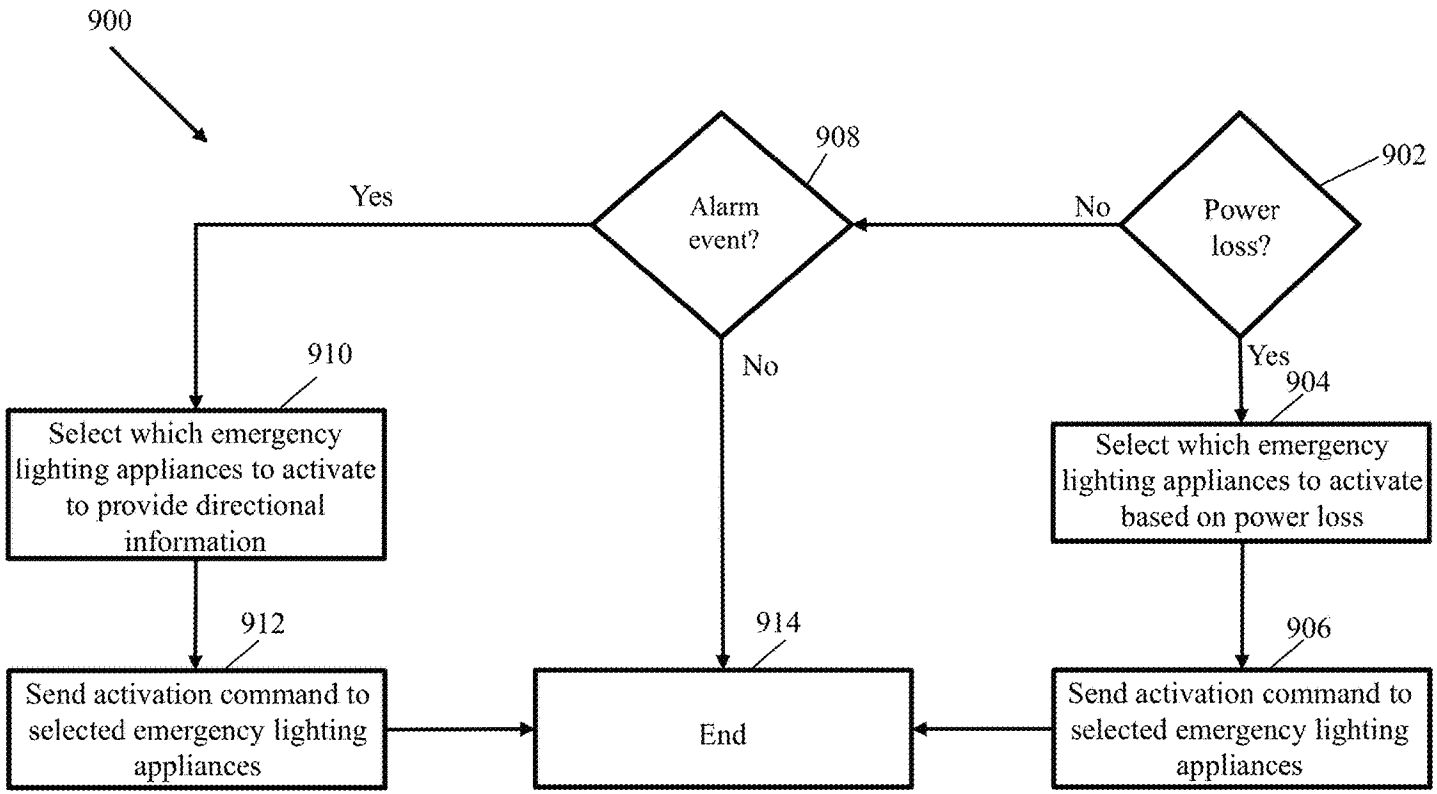
FIG. 9 is an exemplary flow chart of operation of the control panel(s) in an emergency lighting mode and an alarm event mode.

FIG. 9 is an exemplary flow chart 900 of operation of the control panel(s) in an emergency lighting mode and an alarm event mode. As discussed above, the emergency lighting appliances may be operated in different modes, such as a loss of power mode and an alarm event mode. For example, at 902, the control panel(s) may determine that there is a loss of AC power in part or all of a premises. Responsive to determining that there is a loss of AC power, at 904, the control panel(s) may select which emergency lighting appliances to activate based on the AC power loss. For example, in response to determining that an entire building has lost AC power, the control panel(s) may select all of the emergency lighting appliances resident in the building to activate. As another example, responsive to determining that only one building in a campus of buildings has lost AC power, the control panel(s) may select all of the emergency lighting appliances resident in that one building to activate, without activating the emergency lighting appliances resident in other buildings on the campus. At 906, the control panel(s) may then send an activation command to the selected emergency lighting appliances. Responsive to receipt of the activation command, the selected emergency lighting appliances may activate their respective lamps (or other lighting device).

Responsive to determining that there is no power loss, at 908, the control panel(s) may determine that there is an alarm event in part or all of a premises. If there is no alarm event, flow chart 900 goes to end 914. Responsive to determining that there is an alarm event, at 910, the control panel(s) may select which emergency lighting appliances to activate to provide directional information. At 912, the control panel(s) may then send an activation command to the selected emergency lighting appliances. Responsive to receipt of the activation command, the selected emergency lighting appliances may activate their respective lamps (or other lighting device) in order to output the directional information.

Figure 10:
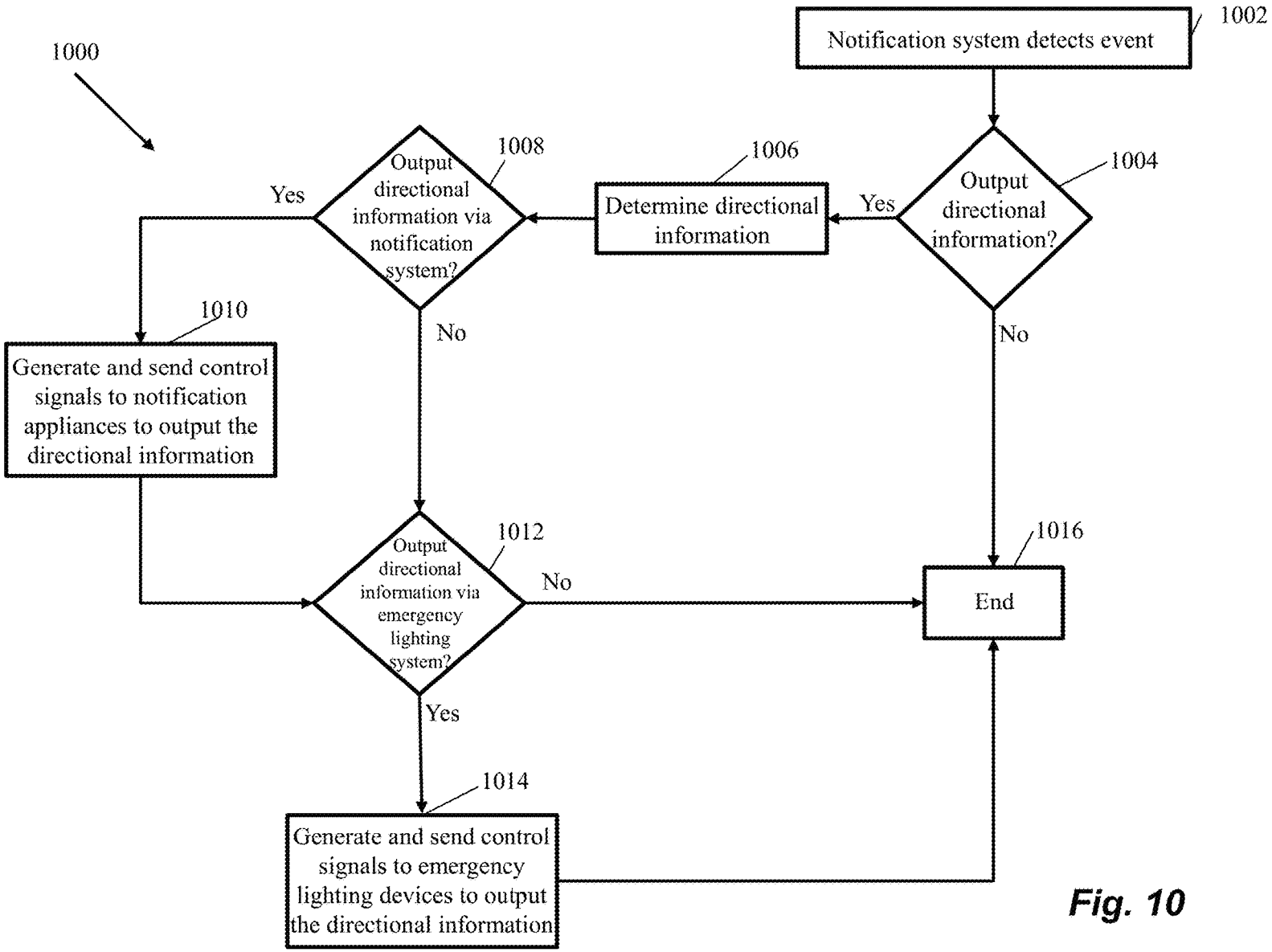
FIG. 10 is an exemplary flow chart of operation of the control panel(s) in generating and sending the directional information to the notification appliance and/or the emergency lighting appliance.

FIG. 10 is an exemplary flow chart 1000 of operation of the control panel(s) in generating and sending the directional information to the notification appliance and/or the emergency lighting appliance. As discussed above, one or control more panels, such as the fire alarm control panel, mass notification control panel, and/or the emergency lighting control panel, may determine whether (and optionally how) to send the directional information. At 1002, the notification system detects or identifies an event, such as an alarm event. For example, with regard to a fire notification system, the fire alarm panel may determine that there is a fire alarm event. As another example, with regard to a mass notification system, the mass notification panel may determine that there is a mass notification event (e.g., an active shooter or intruder). Responsive to detecting the event, at 1004, the panel(s) may determine whether to output directional information. If it is determined not to output direction information, flow chart 1000 proceeds to end 916. If it is determined to output direction information, at 1006, the directional information to output is determined (e.g., a safe path to exit, a shelter-in-place determination, etc.). At 1008, it is further determined whether to output directional information via the notification system. As discussed above, directional information may be output via a fire notification appliance of a fire notification system or a mass notification appliance of a mass notification system. In response to determining to output directional information via the notification system, at 1010, the panel(s) generate and send control signals to notification appliances to output the directional information. For example, responsive to determining a fire alarm event, the panel(s) may determine at 1006 an area or path that is safe for exit. The panel(s) may then identify the fire notification appliances in the path that is safe for exit, and send signals (such as fire notification appliance command) to the identified fire notification appliances so that directional information may be output at the identified fire notification appliances in the path that is safe for exit. As another example, responsive to determining a mass notification event, the panel(s) may determine at 1006 an area or path that is safe for exit or an area to shelter in place. The panel(s) may then identify the mass notification appliances in the path that is safe for exit or an area to shelter in place, and send signals (such as mass notification appliance command) so that directional information may be output at the identified mass notification appliances in the path that is safe for exit or an area to shelter in place.

If directional information is not to be output via the notification system, flow chart 1000 proceeds to 1012 in order to determine whether to output directional information via the emergency lighting system. If not, flow chart 1000 ends at 1016. If so, at 1014, the panel(s) generate and send control signals to the emergency lighting appliances to output the directional information. As one example, responsive to determining a fire alarm event, the panel(s) may determine an area or path that is safe for exit. The panel(s) may then identify the emergency lighting appliances in the path that is safe for exit, and send signals to the identified emergency lighting appliances so that directional information may be output at the identified emergency lighting appliances in the path that is safe for exit. The identified emergency lighting appliances in the path that is safe for exit may comprise a subset of the emergency lighting appliances that are in the building. In particular, there may be a first set of emergency lighting appliances that lead to the north stairwell, and a second set of emergency lighting appliances that lead to the south stairwell. Responsive to determining that the path to the north stairwell is safe for exit, the first set of emergency lighting appliances may be selected for output of the directional information (and a remainder of the emergency lighting appliances in the second set are operated differently, such as not activated at all). As another example, responsive to determining a fire alarm event, the panel(s) may determine an area or path that is unsafe for exit. The panel(s) may then identify the emergency lighting appliances in the path that is unsafe for exit, and send signals to the identified emergency lighting appliances so that directional information may be output at the identified emergency lighting appliances in the path that is unsafe for exit. In the example above, responsive to determining that the path to the south stairwell is unsafe for exit, the second set of emergency lighting appliances may be selected for output of the directional information. As still another example, responsive to determining a mass notification event, the panel(s) may determine an area or path that is safe for exit or an area to shelter in place. The panel(s) may then identify the emergency lighting appliances in the path (such as the subset of emergency lighting appliances) that is safe for exit or an area to shelter in place, and send signals to the identified emergency lighting appliances so that directional information may be output at the identified emergency lighting appliances in the path that is safe for exit or an area to shelter in place.

Figure 11:
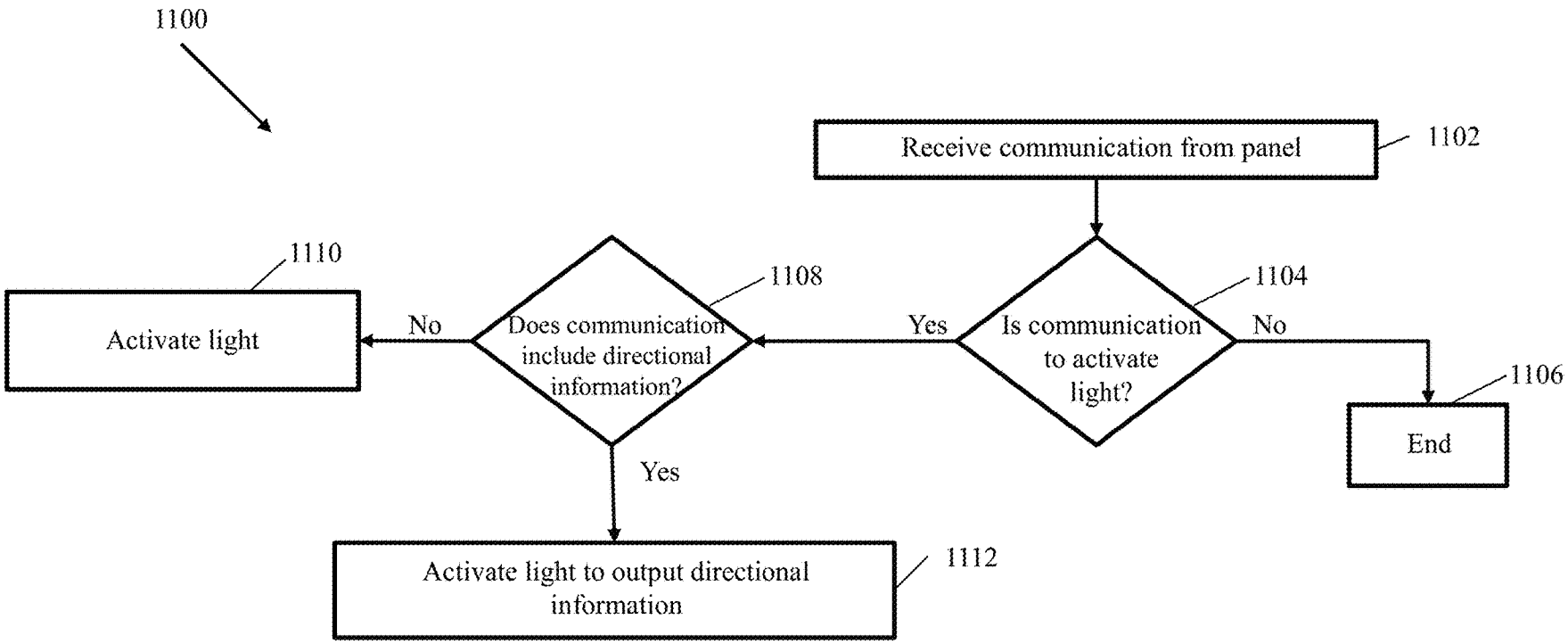
FIG. 11 is an exemplary flow chart of operation of the emergency lighting appliance to output the directional information.

FIG. 11 is an exemplary flow chart 1100 of operation of the emergency lighting appliance to output the directional information. At 1102, the emergency lighting appliance receives a communication from the panel. At 1104, the emergency lighting appliance determines whether the communication is to activate the light. If not, flow chart 1100 proceeds to end 1106. If so, at 1108, the emergency lighting appliance determines whether the communication includes directional information. If not, at 1110, the emergency lighting appliance activates the light. If so, at 1112, the emergency lighting appliance activates the light to include directional information.

While the invention has been described with reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. A control panel, comprising:

a communication interface configured to communicate with emergency lighting appliances in an emergency lighting system and notification appliances in a notification system; and a controller in communication with the communication interface, the controller configured to:

identify an alarm event for the notification system;

identify a region on a premises indicative of a safe place or safe passage for occupants of the premises based on determining whether the alarm event is responsive to receiving an alarm signal from a sensor;

identify, based on the identified region on the premises, a subset of the emergency lighting appliances that comprises less than all of the emergency lighting appliances in the emergency lighting system associated with the safe place or the safe passage;

send a command to the identified subset of the emergency lighting appliances, the command indicative to generate an output indicative to the occupants of the premises of the safe place or the safe passage;

identify, based on the identified region on the premises, a subset of notification appliances in proximity to one or more exits not to be used to exit from the premises, wherein the subset of the notification appliances comprises less than all of the notification appliances in the notification system; and send a second command to the identified subset of the notification appliances, the second command indicative to turn off the identified subset of the notification appliances during the alarm event to avoid indicating the one or more exits not to be used to exit the premises.

2. The control panel of claim 1, wherein, in response to the identified alarm event, a remainder of the emergency lighting appliances in the emergency lighting system remain inactive.

3. The control panel of claim 2, wherein the command to the identified subset of the emergency lighting appliances comprises a command indicative to the identified subset of the emergency lighting appliances to turn on respective lights, associated with the identified subset of the emergency lighting appliances, in a constantly-on mode.

4. The control panel of claim 2, wherein the alarm event comprises a fire alarm event;

wherein the notification appliances comprise fire notification appliances;

wherein the notification system comprises a fire notification system;

wherein the identified region on the premises comprises the safe passage exiting the premises in order to escape the fire alarm event; and wherein the controller is further configured to send a fire notification appliance command to one or more of the fire notification appliances to activate.

5. The control panel of claim 4, wherein the fire notification appliance command is indicative to the one or more of the fire notification appliances to strobe, wherein strobing of the one or more of the fire notification appliances is indicative of the fire alarm event without being indicative to the occupants of the premises of the safe place or the safe passage.

6. The control panel of claim 4, wherein the controller is further configured to identify, based on the identified region on the premises, a subset of fire notification appliances, wherein the subset of the fire notification appliances comprises less than all of the fire notification appliances in the fire notification system; and wherein the controller is configured to send the fire notification appliance command to the identified subset of the fire notification appliances, the fire notification appliance command indicative to the identified subset of the fire notification appliances to generate an output indicative to the occupants of the premises the safe passage exiting the premises in order to escape the fire alarm event.

7. The control panel of claim 6, wherein the command to the identified subset of the emergency lighting appliances comprises a command indicative to the identified subset of the emergency lighting appliances to turn on respective lights, associated with the identified subset of emergency lighting appliances, in a constantly on mode;

wherein, in response to the identified alarm event, a remainder of the emergency lighting appliances in the emergency lighting system remain inactive; and wherein the fire notification appliance command to the identified subset of fire notification appliances comprises a command indicative to the identified subset of fire notification appliances to strobe respective lights associated with the identified subset of fire notification appliances.

8. The control panel of claim 6, wherein the command to the identified subset of emergency lighting appliances comprises a command indicative to the identified subset of emergency lighting appliances to strobe respective lights associated with the identified subset of emergency lighting appliances; and wherein the fire notification appliance command to the identified subset of fire notification appliances comprises a command indicative to the identified subset of fire notification appliances to strobe respective lights associated with the identified subset of fire notification appliances.

9. The control panel of claim 8, wherein a rate of strobing respective lights associated with the identified subset of emergency lighting appliances is different from a rate of strobing respective lights associated with the identified subset of fire notification appliances.

10. The control panel of claim 2, wherein the alarm event comprises a mass notification event;

wherein the notification appliances comprise mass notification appliances;

wherein the notification system comprises a mass notification system;

wherein the identified region on the premises comprises a safe passage exiting the premises or a shelter in place; and wherein the controller is further configured to send a mass notification appliance command to one or more of the mass notification appliances to activate.

11. The control panel of claim 1, wherein the controller is further configured to include in the command a voice message field, the voice message field indicative to the emergency lighting appliances to generate an aural output indicative of directional information.

12. The control panel of claim 1, wherein the controller is further configured to:

determine a loss of power;

identify one or more emergency lighting appliances to activate based on the loss of power; and send a command to the identified one or more emergency lighting appliances to activate based on the loss of power and to control the identified one or more emergency lighting appliances to generate an output in order to provide lighting during the loss of power.

* * * * *